US005962212A

United States Patent [19]

Suzuki et al.

[11] Patent Number: 5,962,212

[45] Date of Patent: Oct. 5, 1999

[54] THERMOGRAPHIC RECORDING ELEMENT

[75] Inventors: Hiroyuki Suzuki; Toshiaki Kubo; Kohzaburoh Yamada, all of Kanagawa, Japan

[73] Assignee: Fuji Photo Film Co., Ltd., Minami-ashigara, Japan

[21] Appl. No.: 09/089,216

[22] Filed: Jun. 3, 1998

[30] Foreign Application Priority Data

Jun. 9, 1997 [JP] Japan ..... 9-166628

[51] Int. Cl.[6] ..... G03C 1/498

[52] U.S. Cl. ..... 430/619; 430/264; 430/617

[58] Field of Search ..... 430/619, 264, 430/617, 627

[56] References Cited

U.S. PATENT DOCUMENTS

| | | | |
|---|---|---|---|
| 4,937,160 | 6/1990 | Ruger | 430/264 |
| 5,496,695 | 3/1996 | Simpson et al. . | |
| 5,609,986 | 3/1997 | Feduzi et al. | 430/264 |

*Primary Examiner*—Thorl Chea
*Attorney, Agent, or Firm*—Birch, Stewart, Kolasch & Birch, LLP

[57] ABSTRACT

A thermographic recording element comprising an organic acid silver salt, a reducing agent, a specific hydrazine derivative, and optionally, a photosensitive silver halide is improved in storage stability and forms images having high Dmax.

11 Claims, No Drawings

THERMOGRAPHIC RECORDING ELEMENT

BACKGROUND OF THE INVENTION

1. Field of the Invention

This invention relates to a thermographic recording element and more particularly, to a photothermographic recording element suited for the manufacture of graphic printing plates.

2. Prior Art

Photothermographic materials which are processed by a photothermographic process to form photographic images are disclosed, for example, in U.S. Pat. Nos. 3,152,904 and 3,457,075, D. Morgan and B. Shely, "Thermally Processed Silver Systems" in "Imaging Processes and Materials," Neblette, 8th Ed., Sturge, V. Walworth and A. Shepp Ed., page 2, 1969.

These photothermographic materials generally contain a reducible silver source (e.g., organic silver salt), a catalytic amount of a photocatalyst (e.g., silver halide), a toner for controlling the tone of silver, and a reducing agent, typically dispersed in a binder matrix. Photothermographic materials are stable at room temperature. When they are heated at an elevated temperature (e.g., 80° C. or higher) after exposure, redox reaction takes place between the reducible silver source (functioning as an oxidizing agent) and the reducing agent to form silver. This redox reaction is promoted by the catalysis of a latent image produced by exposure. Silver formed by reaction of the organic silver salt in exposed regions provides black images in contrast to unexposed regions, forming an image.

Such photothermographic materials have been used as microphotographic and radiographic photosensitive materials. However, only a few have been used as a graphic printing photosensitive material because the image quality is poor for the printing purpose as demonstrated by low maximum density (Dmax) and soft gradation.

With the recent advance of lasers and light-emitting diodes, scanners and image setters having an oscillation wavelength of 600 to 800 nm find widespread use. There is a strong desire to have a high contrast photosensitive material which has so high sensitivity and Dmax that it may comply with such output devices.

From the contemporary standpoints of environmental protection and space saving, it is strongly desired in the graphic printing field to reduce the quantity of spent solution. Needed in this regard is a technology relating to thermographic photosensitive materials for use in the graphic printing field which can be effectively exposed by means of laser image setters and produce clear black images having a high resolution and sharpness. These thermographic photosensitive materials offer to the customer a simple thermographic system which eliminates a need for solution type chemical agents and is not detrimental to the environment.

U.S. Pat. No. 3,667,958 discloses that a photothermographic element comprising a polyhydroxybenzene combined with a hydroxylamine, reductone or hydrazine has high image quality discrimination and resolution. This combination of reducing agents, however, was found to incur an increase of fog.

For producing a thermographic recording element having high Dmax and high contrast, it is effective to add to the element the hydrazine derivatives described in U.S. Pat. No. 5,496,695. Although this results in a thermographic recording element having high Dmax and high contrast, all of sensitivity, contrast, Dmax, Dmin and storage stability of compounds are not fully satisfied.

Improvements in contrast and storage stability of compounds are achieved by using the hydrazine derivatives described in EP 762196A1, but the fully satisfactory level has not been reached.

SUMMARY OF THE INVENTION

An object of the present invention is to provide a thermographic recording element having high Dmax and improved storage stability. Another object of the present invention is to provide a recording element for use in the manufacture of graphic printing plates and capable of forming images of quality. A further object of the present invention is to provide a printing plate-forming recording element which can be processed in a fully dry basis without a need for wet processing.

Briefly stated, a thermographic (or heat-developable) recording element according to the present invention contains an organic acid silver salt, a reducing agent, and a specific hydrazine derivative. The hydrazine derivative is of the following general formula (I):

(I)

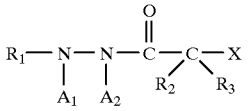

wherein $R_1$ is an aromatic, aliphatic or heterocyclic group, $A_1$and $A_2$ are both hydrogen, or one of $A_1$ and $A_2$ is hydrogen and the other is a substituted or unsubstituted alkylsulfonyl, substituted or unsubstituted arylsulfonyl, or substituted or unsubstituted acyl group, $R_2$ and $R_3$ are independently hydrogen or substituents, and X is —OH, —SH, —NHCOR, —$NHSO_2R$, —NHCONRnRn', —$NHSO_2$NRnRn', —$NHCO_2R$, —NHCOCONRnRn', —$NHCOCO_2R$, —$NHCONRnSO_2R$ or —NRnRn' wherein R is a substituted or unsubstituted alkyl, aryl or heterocyclic group, Rn and Rn' are independently hydrogen, substituted or unsubstituted alkyl, aryl or heterocyclic groups.

In one preferred embodiment, the thermographic recording element further contains a photosensitive silver halide so that the element may be photosensitive. That is, a photothermographic (or photosensitive, heat-developable) recording element is provided.

DETAILED DESCRIPTION OF THE INVENTION

Hydrazine Derivative

The compounds of formula (I) are described in detail.

In formula (I), $R_1$ is an aromatic, aliphatic or heterocyclic group. The aliphatic groups represented by $R_1$ are preferably substituted or unsubstituted, normal, branched or cyclic alkyl, alkenyl and alkynyl groups of 1 to 30 carbon atoms.

The aromatic groups represented by $R_1$ are monocyclic or fused ring aryl groups, for example, benzene rings and naphthalene rings. The heterocyclic groups represented by $R_1$ are monocyclic or fused ring, saturated or unsaturated, aromatic or non-aromatic heterocyclic groups, for example, pyridine, imidazole, morpholino, triazine, pyrimidine, thiazole, thiadiazole, oxazole, quinoline, isoquinoline, benzothiazole, pyrazole, benzimidazole, piperidine, and piperazine rings.

$R_1$ is preferably selected from aryl, alkyl and heterocyclic groups.

The groups represented by $R_1$ may have substituents. Exemplary substituents include halogen atoms (such as fluorine, chlorine, bromine and iodine atoms), alkyl groups including aralkyl, cycloalkyl and active methine groups, alkenyl groups, alkynyl groups, aryl groups, heterocyclic groups, quaternized nitrogen atom-containing heterocyclic groups (such as pyridinio), acyl groups, alkoxycarbonyl groups, aryloxycarbonyl groups, carbamoyl groups, carboxy groups or salts thereof, sulfonylcarbamoyl groups, acylcarbamoyl groups, sulfamoylcarbamoyl groups, carbazoyl groups, oxalyl groups, oxamoyl groups, cyano groups, thiocarbamoyl groups, hydroxy groups, alkoxy groups (including groups containing recurring ethyleneoxy or propyleneoxy units), aryloxy groups, heterocyclic oxy groups, acyloxy groups, (alkoxy or aryloxy)carbonyloxy groups, carbamoyloxy groups, sulfonyloxy groups, amino groups, (alkyl, aryl or heterocyclic) amino groups, N-substituted nitrogenous heterocyclic groups, acylamino groups, sulfonamide groups, ureido groups, thioureido groups, imide groups, (alkoxy or aryloxy) carbonylamino groups, sulfamoylamino groups, semicarbazide groups, thiosemicarbazide groups, hydrazino groups, quaternary ammonio groups, oxamoylamino groups, (alkyl or aryl) sulfonylureido groups, acylureido groups, acylsulfamoylamino groups, nitro groups, mercapto groups, (alkyl, aryl or heterocyclic) thio groups, (alkyl or aryl) sulfonyl groups, (alkyl or aryl) sulfinyl groups, sulfo groups or salts thereof, sulfamoyl groups, acylsulfamoyl groups, sulfonylsulfamoyl groups or salts thereof, and phosphoramide or phosphate structure-bearing groups. These substituents may be further replaced by other substituents selected from the foregoing examples.

Where $R_1$ is aromatic or heterocyclic groups, preferred substituents that $R_1$ may have are alkyl (including active methylene), aralkyl, heterocyclic, substituted amino, acylamino, sulfonamide, ureido, sulfamoylamino, imide, thioureido, phosphoramide, hydroxy, alkoxy, aryloxy, acyloxy, acyl, alkoxycarbonyl, aryloxycarbonyl, carbamoyl, carboxy (including salts thereof), (alkyl, aryl or heterocyclic) thio, sulfo (including salts thereof), sulfamoyl, halogen, cyano, and nitro groups.

Where $R_1$ represents aliphatic groups, preferred substituents that $R_1$ may have are alkyl, aryl, heterocyclic, amino, acylamino, sulfonamide, ureido, sulfamoylamino, imide, thioureido, phosphoramide, hydroxy, alkoxy, aryloxy, acyloxy, acyl, alkoxycarbonyl, aryloxycarbonyl, carbamoyl, carboxy (including salts thereof), (alkyl, aryl or heterocyclic) thio, sulfo (including salts thereof), sulfamoyl, halogen, cyano, and nitro groups.

In formula (I), $R_1$ is more preferably selected from substituted or unsubstituted phenyl groups, substituted alkyl groups of 1 to 3 carbon atoms, and substituted or unsubstituted heterocyclic groups of up to 10 carbon atoms.

Where $R_1$ represents substituted alkyl groups of 1 to 3 carbon atoms, it is more preferably substituted methyl groups, and further preferably di- or tri-substituted methyl groups. Exemplary preferred substituents on these methyl groups include methyl, phenyl, cyano, (alkyl, aryl or heterocyclic) thio, alkoxy, aryloxy, chloro, heterocyclic, alkoxycarbonyl, aryloxycarbonyl, carbamoyl, sulfamoyl, amino, acylamino, and sulfonamide groups, and especially, substituted or unsubstituted phenyl groups.

Where $R_1$ represents substituted methyl groups, preferred examples thereof are t-butyl, dicyanomethyl, dicyanophenylmethyl, triphenylmethyl (trityl), diphenylmethyl, methoxycarbonyldiphenylmethyl, cyanodiphenylmethyl, methylthiodiphenylmethyl, cyclopropyldiphenylmethyl groups, with trityl being most preferred.

Where $R_1$ represents heterocyclic groups, preferred examples thereof are pyridine, quinoline, pyrimidine, triazine, benzthiazole, benzimidazole, thiphene and methylenedioxybenzene rings.

Further preferably, $R_1$ is selected from substituted or unsubstituted phenyl groups and substituted or unsubstituted aromatic heterocyclic groups. Preferred substituents on these groups include nitro, cyano, alkoxy, alkyl, acylamino, ureido, sulfonamide, thioureido, carbamoyl, sulfamoyl, sulfonyl, carboxy (or salts thereof), sulfo (or salts thereof), alkoxycarbonyl and chloro groups.

In formula (I), $A_1$ and $A_2$ are hydrogen atoms, (alkyl or aryl) sulfonyl groups of up to 20 carbon atoms (preferably phenylsulfonyl groups or substituted phenylsulfonyl groups which are substituted so that the sum of Hammette's substituent constants is at least −0.5), acyl groups of up to 20 carbon atoms (preferably benzoyl groups or substituted benzoyl groups which are substituted so that the sum of Hammette's substituent constants is at least −0.5), or normal, branched or cyclic, substituted or unsubstituted aliphatic acyl groups (exemplary substituents including halogen, ether, sulfonamide, carbonamide, hydroxyl, carboxy and sulfonate groups). Most preferably, $A_1$ and $A_2$ are hydrogen atoms.

In formula (I), $R_2$ and $R_3$, which may be the same or different, are hydrogen or substituents. The substituents represented by $R_2$ and $R_3$ are the same as the above-described substituents that $R_1$ may have. Preferred substituents are those of 0 to 10 carbon atoms in total, especially 0 to 6 carbon atoms in total, for example, hydrogen atoms, halogen atoms (e.g., fluoro and chloro), alkyl groups (e.g., methyl, ethyl and benzyl), aryl groups (e.g., phenyl and 4-methylphenyl), alkoxy groups (e.g., methoxy and isopropoxy), aryloxy groups (e.g., phenoxy), amino groups (e.g., dimethylamino and propylamino), alkoxycarbonyl groups (e.g., ethoxycarbonyl and benzyloxycarbonyl), and aryloxycarbonyl groups (e.g., phenoxycarbonyl and naphthoxycarbonyl). $R_2$ and $R_3$, taken together, may form a cyclic structure. $R_2$ and $R_3$ may further have substituents thereon, and exemplary substituents are the same as the above-described substituents that $R_1$ may have, preferably those of 0 to 10 carbon atoms in total, especially 0 to 6 carbon atoms in total, for example, the exemplified substituents represented by $R_2$ and $R_3$ themselves.

Most preferably, $R_2$ and $R_3$ are hydrogen.

In formula (I), X is —OH, —SH, —NHCOR, —$NHSO_2R$, —NHCONRnRn', —$NHSO_2NRnRn'$, —$NHCO_2R$, —NHCOCONRnRn', —$NHCOCO_2R$, —$NHCONRnSO_2R$ or —NRnRn' and more preferably, —OH, —NHCOR, —$NHSO_2R$ or —NRnRn'. Herein, R preferably represents substituted or unsubstituted alkyl, aryl or heterocyclic groups of 1 to 20 carbon atoms in total, more preferably 1 to 10 carbon atoms in total, for example, alkyl groups such as methyl, ethyl, trifluoromethyl, difluoromethyl, benzyl, 3-hydroxypropyl, 2-carboxyethyl, ethoxycarbonylmethyl, and dimethylaminoethyl; aryl groups such as phenyl, naphthyl, perfluorophenyl, 4-methoxyphenyl, 4-dimethylanilino, and 2-methanesulfonamidophenyl; and heterocyclic groups such as morpholino, imidazolyl, pyridyl, and 2,2,6,6-tetramethylpiperidin-4-yl. Rn and Rn' are preferably hydrogen or substituted or unsubstituted alkyl, aryl or heterocyclic groups of 1 to 20 carbon atoms in total, more preferably 1 to 10 carbon atoms in total. Where Rn and Rn' are alkyl, aryl or heterocyclic groups, illustrative examples of these groups are the same as the groups represented by R. R, Rn, and Rn' may further have substituents, examples of which are the same as the above-described substituents that $R_1$ may have, preferably those of 0 to 10 carbon atoms in total, especially 0 to 6 carbon atoms in total, for example, the exemplified substituents represented by R itself.

Illustrative preferred examples of the group represented by X include hydroxyl, mercapto, phenylsulfonamide, perfluorophenylsulfonamide, methanesulfonamide, trifluoromethanesulfonamide, trifluoroacetamide, perfluorobenzoylamide, unsubstituted amino, dimethylamino, and propylamino groups.

The hydrazine derivatives of formula (I) may have incorporated therein a group capable of adsorbing to silver halide. Such adsorptive groups include alkylthio, arylthio, thiourea, thioamide, mercapto heterocyclic, and triazole groups and are described in U.S. Pat. Nos. 4,385,108, 4,459,347, JP-A 195233/1984, 200231/1984, 201045/1984, 201046/1984, 201047/1984, 201048/1984, 201049/1984, 170733/1986, 270744/1986, 948/1987, 234244/1988, 234245/1988, and 234246/1988. The silver halide adsorbing groups may take the form of precursors. The precursors are exemplified by the groups described in JP-A 285344/1990.

The hydrazine derivatives of formula (I) may have incorporated therein a ballast group or polymer commonly used in immobile photographic additives such as couplers. The ballast group is a group having at least 8 carbon atoms and relatively inert with respect to photographic properties. It may be selected from, for example, alkyl, aralkyl, alkoxy, phenyl, alkylphenyl, phenoxy, and alkylphenoxy groups. The polymer is exemplified in JP-A 100530/1989, for example.

The hydrazine derivatives of formula (I) each may have a plurality of hydrazino groups as substituents. In this case, the compound of formula (I) is a multiple union of hydrazino groups. Illustrative examples are described in JP-A 86134/1989, JP-A 16938/1992, JP-A 197091/1993, WO 95-32452, WO 95-32453, Japanese Patent Application Nos. 351132/1995, 351269/1995, 351168/1995, 351287/1995, and 351279/1995.

The hydrazine derivatives of formula (I) may contain therein cationic groups (for example, quaternary ammonio group-bearing groups and quaternized nitrogen atom-bearing nitrogenous heterocyclic groups), groups containing recurring ethyleneoxy or propyleneoxy units, (alkyl, aryl or heterocyclic) thio groups, or groups dissociable with bases (e.g., carboxy, sulfo, acylsulfamoyl and carbamoylsulfamoyl groups). Exemplary compounds containing such groups are described in JP-A 234471/1995, 333466/1993, 19032/1994, 19031/1994, 45761/1993, U.S. Pat. Nos. 4,994,365, 4,988,604, JP-A 259240/1995, 5610/1995, 244348/1995, German Patent No. 4006032.

Illustrative, non-limiting, examples of the compounds of formula (I) are given below.

TABLE 1

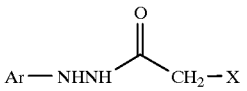

| Ar | X: —OH | —SH | —NHCOCF$_3$ | —NHSO$_2$Ph | —N(CH$_3$)$_2$ |
|---|---|---|---|---|---|
| 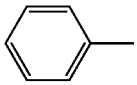 | 1a | 1b | 1c | 1d | 1e |
| 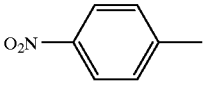 | 2a | 2b | 2c | 2d | 2e |
| 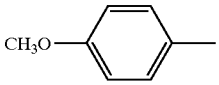 | 3a | 3b | 3c | 3d | 3e |
| 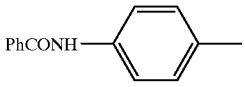 | 4a | 4b | 4c | 4d | 4e |
| 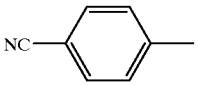 | 5a | 5b | 5c | 5d | 5e |
| 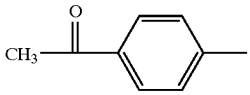 | 6a | 6b | 6c | 6d | 6e |

TABLE 1-continued
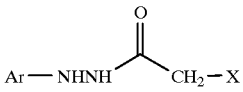
| Ar | X: —OH | —SH | —NHCOCF$_3$ | —NHSO$_2$Ph | —N(CH$_3$)$_2$ |
|---|---|---|---|---|---|
| 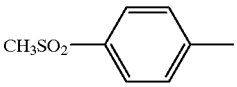 | 7a | 7b | 7c | 7d | 7e |
| 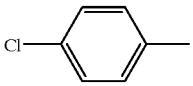 | 8a | 8b | 8c | 8d | 8e |
| 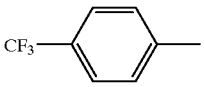 | 9a | 9b | 9c | 9d | 9e |
| 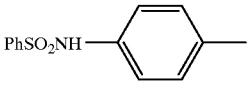 | 10a | 10b | 10c | 10d | 10e |
| 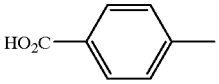 | 11a | 11b | 11c | 11d | 11e |
TABLE 2
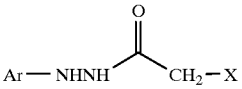
| Ar | X: —OH | —SH | —NHCOCF$_3$ | —NHSO$_2$CH$_3$ | —NH$_2$ |
|---|---|---|---|---|---|
| 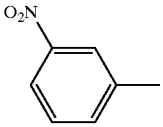 | 12a | 12b | 12c | 12d | 12e |
| 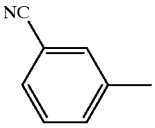 | 13a | 13b | 13c | 13d | 13e |
| 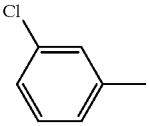 | 14a | 14b | 14c | 14d | 14e |

TABLE 2-continued
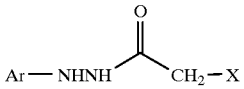
| Ar | X: —OH | —SH | —NHCOCF$_3$ | —NHSO$_2$CH$_3$ | —NH$_2$ |
|---|---|---|---|---|---|
| 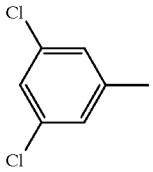 | 15a | 15b | 15c | 15d | 15e |
| 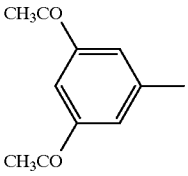 | 16a | 16b | 16c | 16d | 16e |
| 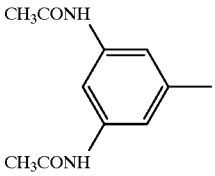 | 17a | 17b | 17c | 17d | 17e |
| 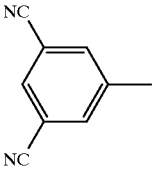 | 18a | 18b | 18c | 18d | 18e |
| 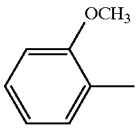 | 19a | 19b | 19c | 19d | 19e |
| 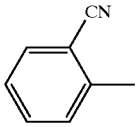 | 20a | 20b | 20c | 20d | 20e |
| 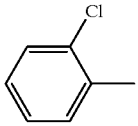 | 21a | 21b | 21c | 21d | 21e |
| 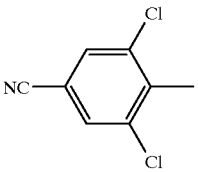 | 22a | 22b | 22c | 22d | 22e |

TABLE 3
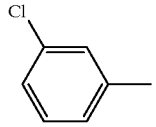
| Ar | X: —OH | —SH | —NHCOCF$_3$ | —NHSO$_2$Ph | —NHPh |
|---|---|---|---|---|---|
| 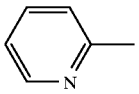 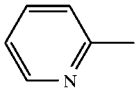 | 23a | 23b | 23c | 23d | 23e |
| 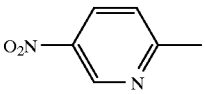 | 24a | 24b | 24c | 24d | 24e |
| 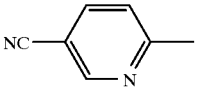 | 25a | 25b | 25c | 25d | 25e |
| 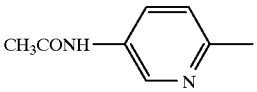 | 26a | 26b | 26c | 26d | 26e |
| 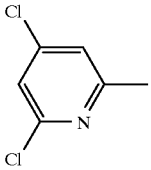 | 27a | 27b | 27c | 27d | 27e |
| 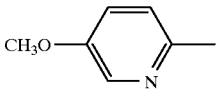 | 28a | 28b | 28c | 28d | 28e |
| 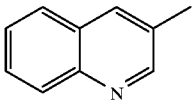 | 29a | 29b | 29c | 29d | 29e |
| 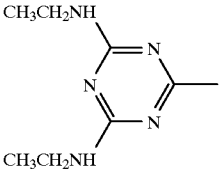 | 30a | 30b | 30c | 30d | 30e |
| 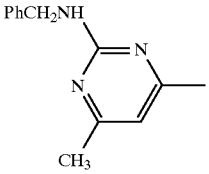 | 31a | 31b | 31c | 31d | 31e |

TABLE 3-continued
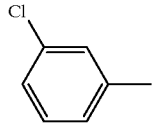
| Ar | X | | | | |
|---|---|---|---|---|---|
| | —OH | —SH | —NHCOCF$_3$ | —NHSO$_2$Ph | —NHPh |
| 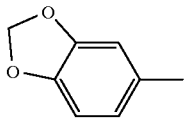 | 32a | 32b | 32c | 32d | 32e |
| 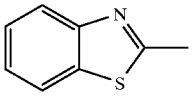 | 33a | 33b | 33c | 33d | 33e |
TABLE 4
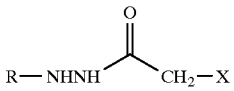
| R | X | | | | |
|---|---|---|---|---|---|
| | —OH | —SH | —NHCOCF$_3$ | —NHSO$_2$CH$_3$ | —N(CH$_3$)$_2$ |
| 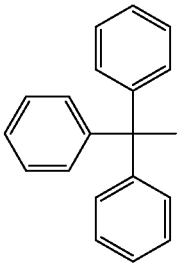 | 34a | 34b | 34c | 34d | 34e |
| 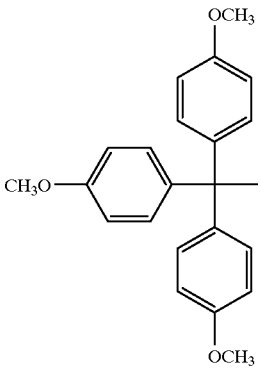 | 35a | 35b | 35c | 35d | 35e |

TABLE 4-continued
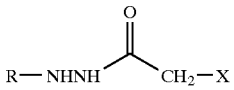
| R | X | | | | |
|---|---|---|---|---|---|
| | —OH | —SH | —NHCOCF$_3$ | —NHSO$_2$CH$_3$ | —N(CH$_3$)$_2$ |
| 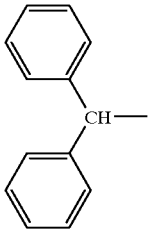 | 36a | 36b | 36c | 36d | 36e |
| 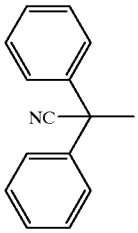 | 37a | 37b | 37c | 37d | 37e |
| 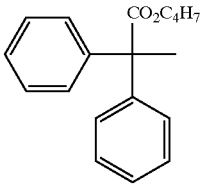 | 38a | 38b | 38c | 38d | 38e |
| 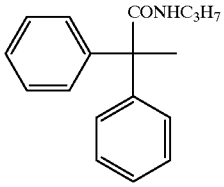 | 39a | 39b | 39c | 39d | 39e |
| 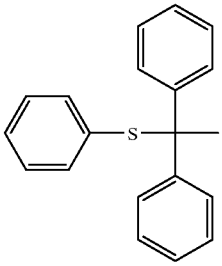 | 40a | 40b | 40c | 40d | 40e |
| 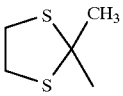 | 41a | 41b | 41c | 41d | 41e |

TABLE 4-continued
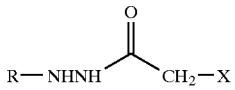
| R | X: —OH | —SH | —NHCOCF$_3$ | —NHSO$_2$CH$_3$ | —N(CH$_3$)$_2$ |
|---|---|---|---|---|---|
| 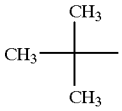 | 42a | 42b | 42c | 42d | 42e |
TABLE 5
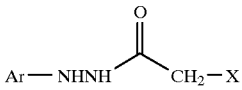
| Ar | X: —OH | —SH | NHCOCF$_3$ | —NHSO$_2$Ph | —N(CH$_3$)$_2$ |
|---|---|---|---|---|---|
| 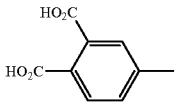 | 43a | 43b | 43c | 43d | 43e |
| 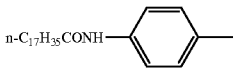 | 44a | 44b | 44c | 44d | 44e |
| 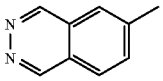 | 45a | 45b | 45c | 45d | 45e |
| 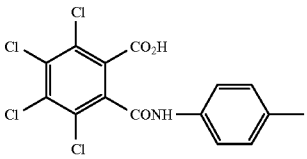 | 46a | 46b | 46c | 46d | 46e |
| 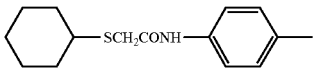 | 47a | 47b | 47c | 47d | 47e |
| 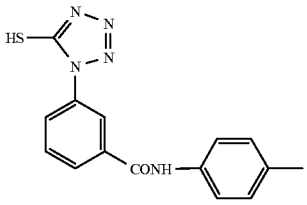 | 48a | 48b | 48c | 48d | 48e |
| 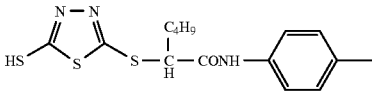 | 49a | 49b | 49c | 49d | 49e |

TABLE 5-continued
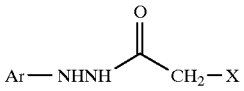
| Ar | X | | | | |
|---|---|---|---|---|---|
| | —OH | —SH | $NHCOCF_3$ | $—NHSO_2Ph$ | $—N(CH_3)_2$ |
| 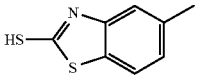 | 50a | 50b | 50c | 50d | 50e |
| 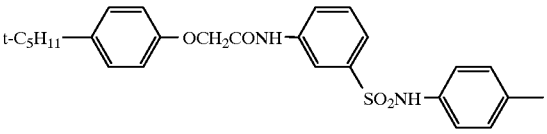 | 51a | 51b | 51c | 51d | 51e |
| 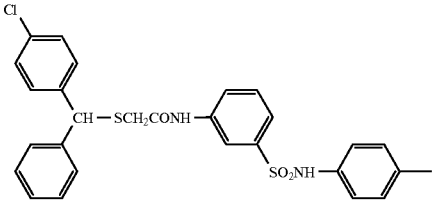 | 52a | 52b | 52c | 52d | 52e |
| 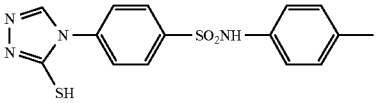 | 53a | 53b | 53c | 53d | 53e |
| 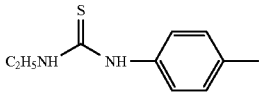 | 54a | 54b | 54c | 54d | 54e |
| 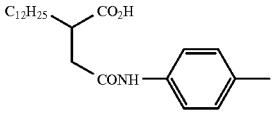 | 55a | 55b | 55c | 55d | 55e |
| 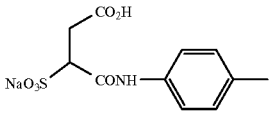 | 56a | 56b | 56c | 56d | 56e |
TABLE 6
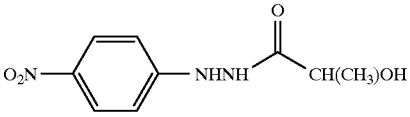
57
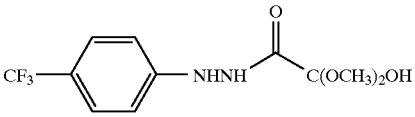
58

TABLE 6-continued
59
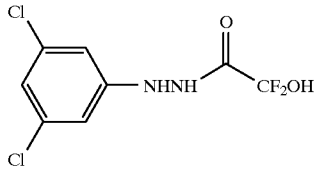
60
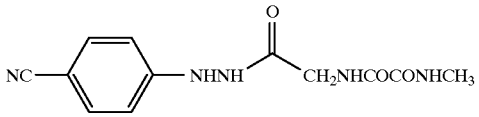
61
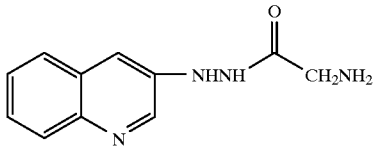
62
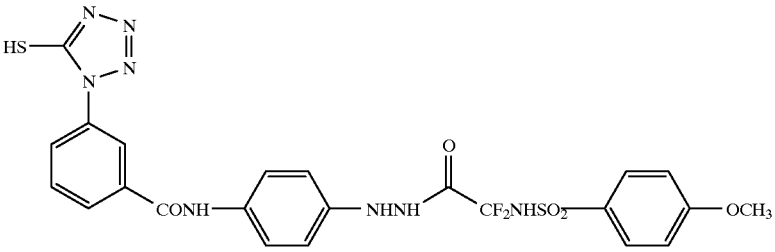
63
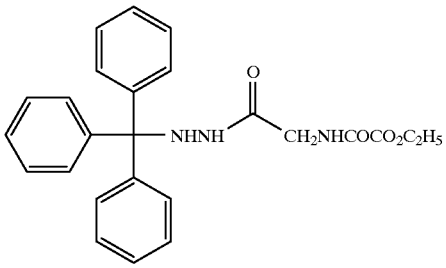
64
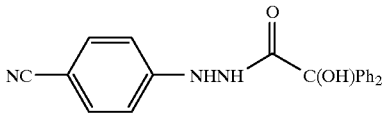
65
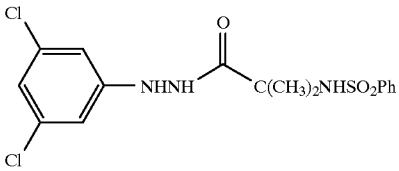
66
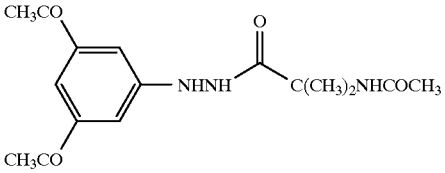

TABLE 6-continued
| | |
|---|---|
| 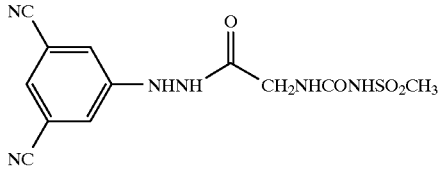 | 67 |
| 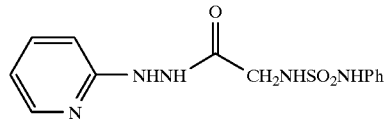 | 68 |
| 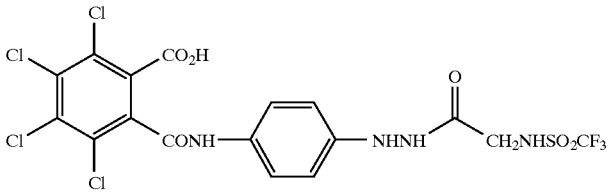 | 69 |
| 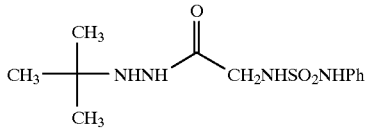 | 70 |
TABLE 7
| | |
|---|---|
| 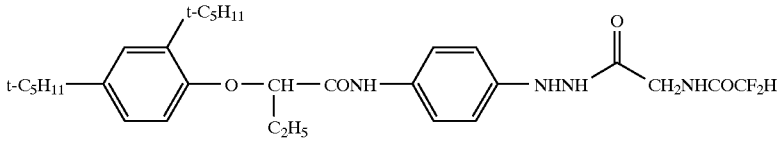 | 71 |
| 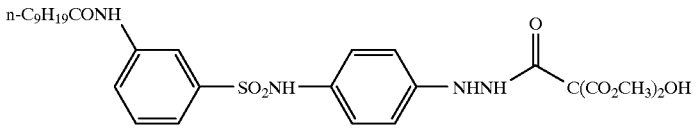 | 72 |
| 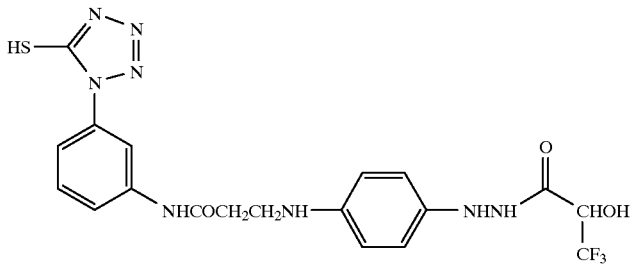 | 73 |
| 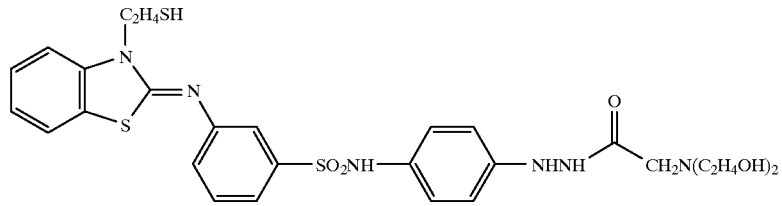 | 74 |

TABLE 7-continued
75
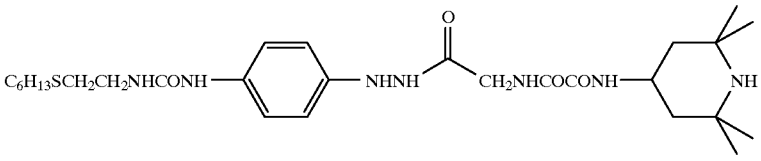
76
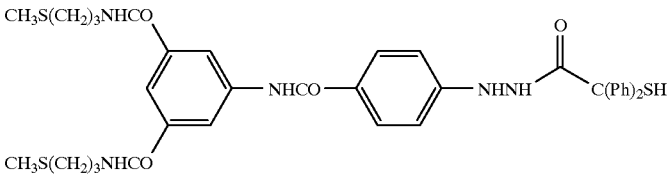
77
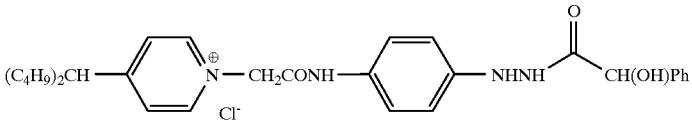
78
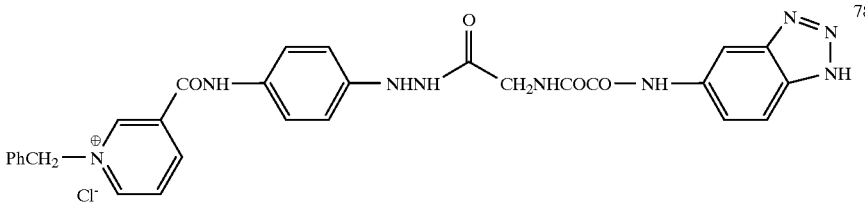
TABLE 8
79
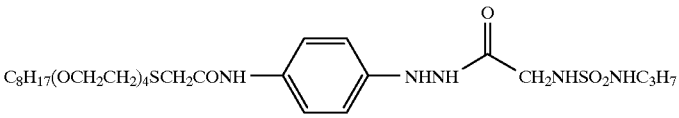
80
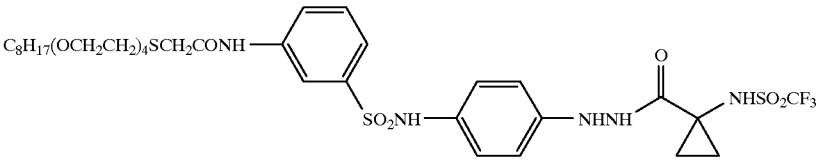
81
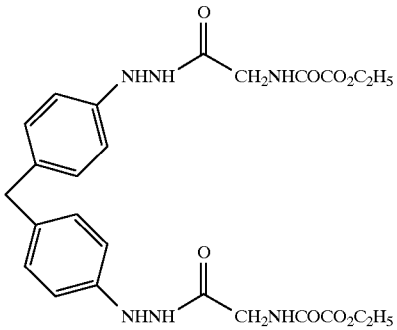

TABLE 8-continued

82

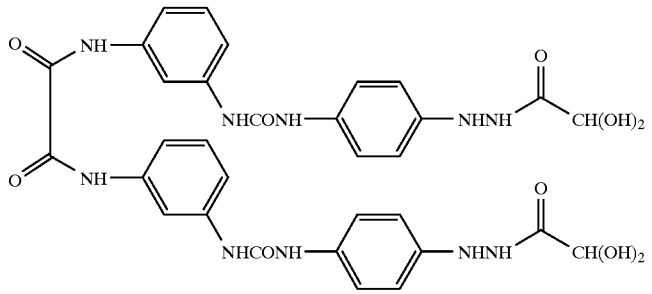

83

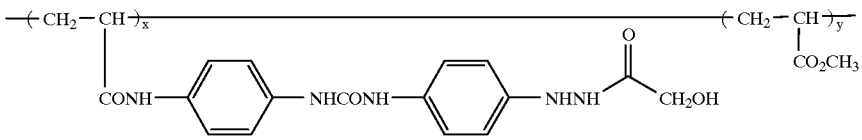

x:y = 3:97
average molecule weight ~ 100,000

84

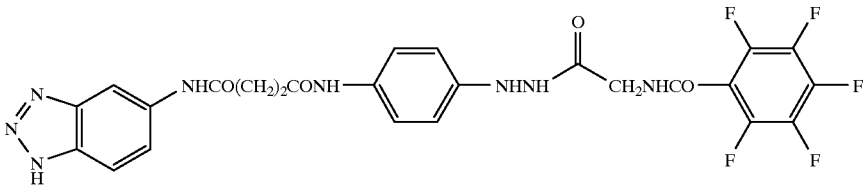

85

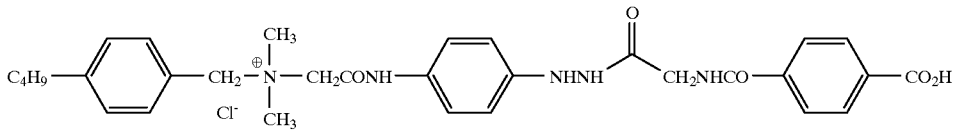

86

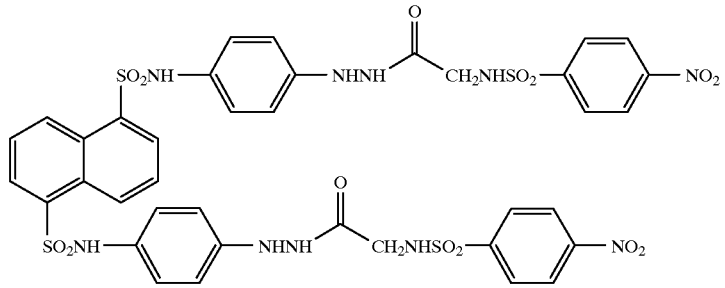

The compounds of formula (I) can be synthesized by a variety of well-known methods. Since an appropriate method should be selected for the synthesis of a particular compound, it is impossible to describe a general synthesis method covering the majority of compounds. Several effective synthesis routes are shown below for illustrative purposes, but not for limitative purposes. DMF is dimethylformamide and DMAC is dimethylacetamide.

SYNTHESIS EXAMPLES

Synthesis of Exemplary Compound 2a

A solution of 29.5 g of p-nitrophenylhydrazine and 43 g of glycolic acid in 120 ml of acetonitrile was heated under reflux for 2 hours and gradually cooled to room temperature. The precipitated solid was collected by filtration, obtaining 26 g of Exemplary Compound 2a.

Synthesis of Exemplary Compound 2d

To a solution of 5 g of N-benzenesulfonylglycine in 25 ml of methylene chloride, 0.5 ml of DMF was added, and 2.2 ml of oxalyl chloride was added dropwise. After stirring for 1 hour at room temperature, the solvent was distilled off. To the residue were added 50 ml of acetonitrile, 3.2 g of imidazole, and 30 ml of DMAC. With ice cooling, this solution was added dropwise to 60 ml of an acetonitrile-DMAC mixture containing 3.6 g of p-nitrophenylhydrazine and stirred for 1 hour. Ethyl acetate and dilute hydrochloric acid were added to the reaction solution whereupon the product was extracted, dried, and concentrated. Recrystallization from methylene chloride yielded 6 g of Exemplary compound 2d.

Synthesis of Exemplary Compound 2c

To a solution of 5 g of N-trifluoroacetylglycine in 25 ml of methylene chloride, 0.5 ml of DMF was added, and 2.8 ml of oxalyl chloride was added dropwise. After stirring for 1 hour at room temperature, the solvent was distilled off. To the residue were added 50 ml of acetonitrile, 4 g of imidazole, and 20 ml of DMAC. With ice cooling, this solution was added dropwise to 70 ml of an acetonitrile-DMAC mixture containing 4.5 g of p-nitrophenylhydrazine and stirred for 1 hour. Ethyl acetate and dilute hydrochloric acid were added to the reaction solution whereupon the product was extracted, dried, and concentrated. Recrystallization from methylene chloride yielded 4 g of Exemplary compound 2c.

Synthesis of Exemplary Compound 15a

To 5 g of 3,5-dichlorophenylhydrazine hydrochloride in 20 ml of acetonitrile were added 3 ml of triethylamine and 5.3 g of glycolic acid. The mixture was heated under reflux for 2 hours. Ethyl acetate and dilute hydrochloric acid were added to the reaction solution whereupon the product was extracted, dried, and concentrated. Recrystallization from ethyl acetate yielded 3.2 g of Exemplary compound 15a.

In the practice of the invention, any of well-known hydrazine derivatives which are shown below may be used in combination with the hydrazine derivatives of formula (I).

Exemplary hydrazine derivatives which can be used in combination include the compounds of the chemical formula [1] in JP-B 77138/1994, more specifically the compounds described on pages 3 and 4 of the same; the compounds of the general formula (I) in JP-B 93082/1994, more specifically compound Nos. 1 to 38 described on pages 8 to 18 of the same; the compounds of the general formulae (4), (5) and (6) in JP-A 230497/1994, more specifically compounds 4-1 to 4-10 described on pages 25 and 26, compounds 5-1 to 5-42 described on pages 28 to 36, and compounds 6-1 to 6-7 described on pages 39 and 40 of the same; the compounds of the general formulae (1) and (2) in JP-A 289520/1994, more specifically compounds 1-1 to 1-17 and 2-1 described on pages 5 to 7 of the same; the compounds of the chemical formulae [2] and [3] in JP-A 313936/1994, more specifically the compounds described on pages 6 to 19 of the same; the compounds of the chemical formula [1] in JP-A 313951/1994, more specifically the compounds described on pages 3 to 5 of the same; the compounds of the general formula (I) in JP-A 5610/1995, more specifically compounds I-1 to I-38 described on pages 5 to 10 of the same; the compounds of the general formula (II) in JP-A 77783/1995, more specifically compounds II-1 to II-102 described on pages 10 to 27 of the same; the compounds of the general formulae (H) and (Ha) in JP-A 104426/1995, more specifically compounds H-1 to H-44 described on pages 8 to 15 of the same; the compounds having an anionic group in proximity to a hydrazine group or a nonionic group capable of forming an intramolecular hydrogen bond with the hydrogen atom of hydrazine described in EP 713131A, especially compounds of the general formulae (A), (B), (C), (D), (E), and (F), more specifically compounds N-1 to N-30 described therein; and the compounds of the general formula (1) in EP 713131A, more specifically compounds D-1 to D-55 described therein.

Also useful are the hydrazine derivatives described in "Known Technology," Aztech K. K., Mar. 22, 1991, pages 25–34 and Compounds D-2 and D-39 described in JP-A 86354/1987, pages 6–7.

In the practice of the invention, the hydrazine nucleating agent is used as solution in a suitable organic solvent. Suitable solvents include alcohols (e.g., methanol, ethanol, propanol, and fluorinated alcohols), ketones (e.g., acetone and methyl ethyl ketone), dimethylformamide, dimethylsulfoxide and methyl cellosolve.

A well-known emulsifying dispersion method is used for dissolving the hydrazine derivative with the aid of an oil such as dibutyl phthalate, tricresyl phosphate, glyceryl triacetate or diethyl phthalate or an auxiliary solvent such as ethyl acetate or cyclohexanone whereby an emulsified dispersion is mechanically prepared. Alternatively, a method known as a solid dispersion method is used for dispersing the hydrazine derivative in powder form in water in a ball mill, colloidal mill or ultrasonic mixer.

The hydrazine nucleating agent may be added to an image forming layer or any other layer on the image forming layer side of a support, and preferably to the image forming layer or a layer disposed adjacent thereto.

The hydrazine nucleating agent is preferably used in an amount of $1\times10^{-6}$ mol to $1\times10^{-1}$ mol, more preferably $1\times10^{-5}$ mol to $5\times10^{-2}$ mol per mol of silver.

In the recording element of the invention, a nucleation promoter may be added for promoting the action of the nucleating agent. The nucleation promoter used herein includes amine derivatives, onium salts, disulfide derivatives, hydroxymethyl derivatives, hydroxamic acid derivatives, acylhydrazide derivatives, acrylonitrile derivatives and hydrogen donors.

Examples of the nucleation promoter include the compounds described in JP-A 77783/1995, page 48, lines 2–37, more specifically Compounds A-1 to A-73 described on pages 49–58 of the same; the compounds of the chemical formulae [21], [22] and [23] described in JP-A 84331/1995, more specifically the compounds described on pages 6–8 of the same; the compounds of the general formulae [Na] and [Nb] described in JP-A 104426/1995, more specifically Compounds Na-1 to Na-22 and Nb-1to Nb-12 described on pages 16–20 of the same; the compounds of the general formulae (1), (2), (3), (4), (5), (6) and (7) described in Japanese Patent Application No. 37817/1995, more specifically Compounds 1-1 to 1-19, Compounds 2-1 to 2-22, Compounds 3-1 to 3-36, Compounds 4-1 to 4-5, Compounds 5-1 to 5-41, Compounds 6-1 to 6-58 and Compounds 7-1 to 7-38 described therein; the compounds described in U.S. Pat. No. 5,545,505, page 19, line 43 to page 22, line 3; the compounds described in U.S. Pat. No. 5,545,507, page 17, line 43 to page 18, line 53; the compounds described in U.S. Pat. No. 5,545,515, page 12, line 31 to page 14, line 14; the compounds described in U.S. Pat. No. 5,558,983, page 16, line 31 to page 17, line 12; the compounds described in WO 97/11407, page 27, line 4 to page 32, line 7; and the nucleation promoters described in Japanese Patent Application No. 70908/1996.

In the practice of the invention, the nucleation promoter is used as solution in water or a suitable organic solvent. Suitable solvents include alcohols (e.g., methanol, ethanol, propanol, and fluorinated alcohols), ketones (e.g., acetone and methyl ethyl ketone), dimethylformamide, dimethylsulfoxide and methyl cellosolve.

A well-known emulsifying dispersion method is used for dissolving the nucleation promoter with the aid of an oil such as dibutyl phthalate, tricresyl phosphate, glyceryl triacetate or diethyl phthalate or an auxiliary solvent such as ethyl acetate or cyclohexanone whereby an emulsified dispersion is mechanically prepared. Alternatively, a method known as a solid dispersion method is used for dispersing the nucleation promoter in powder form in water in a ball mill, colloidal mill or ultrasonic mixer.

The nucleation promoter may be added to an image forming layer or any other binder layer on the image forming layer side of a support, and preferably to the image forming layer or a binder layer disposed adjacent thereto.

The nucleation promoter is preferably used in an amount of $1\times10^{-6}$ mol to $2\times10^{-1}$ mol, more preferably $1\times10^{-5}$ mol to $2\times10^{-2}$ mol, most preferably $2\times10^{-5}$ to $1\times10^{-2}$ mol per mol of silver.

Organic silver salt

The organic silver salt which can be used herein is relatively stable to light, but forms a silver image when heated at 80° C. or higher in the presence of an exposed photocatalyst (as typified by a latent image of photosensitive silver halide) and a reducing agent. The organic silver salt may be of any desired organic compound containing a source capable of reducing silver ion. Preferred are silver salts of organic acids, typically long chain aliphatic carboxylic acids having 10 to 30 carbon atoms, especially 15 to 28 carbon atoms. Also preferred are complexes of organic or inorganic silver salts with ligands having a stability constant in the range of 4.0 to 10.0. A silver-providing substance is preferably used in an amount of about 5 to 70% by weight of an image forming layer. Preferred organic silver salts include silver salts of organic compounds having a carboxyl group. Examples include silver salts of aliphatic carboxylic acids and silver salts of aromatic carboxylic acids though not limited thereto. Preferred examples of the silver salt of aliphatic carboxylic acid include silver behenate, silver arachidate, silver stearate, silver oleate, silver laurate, silver caproate, silver myristate, silver palmitate, silver maleate, silver fumarate, silver tartrate, silver linolate, silver butyrate, silver camphorate and mixtures thereof.

Silver salts of compounds having a mercapto or thion group and derivatives thereof are also useful. Preferred examples of these compounds include a silver salt of 3-mercapto-4-phenyl-1,2,4-triazole, a silver salt of 2-mercaptobenzimidazole, a silver salt of 2-mercapto-5-aminothiadiazole, a silver salt of 2-(ethylglycolamido)-benzothiazole, silver salts of thioglycolic acids such as silver salts of S-alkylthioglycolic acids wherein the alkyl group has 12 to 22 carbon atoms, silver salts of dithiocarboxylic acids such as a silver salt of dithioacetic acid, silver salts of thioamides, a silver salt of 5-carboxyl-1-methyl-2-phenyl-4-thiopyridine, silver salts of mercaptotriazines, a silver salt of 2-mercaptobenzoxazole as well as silver salts of 1,2,4-mercaptothiazole derivatives such as a silver salt of 3-amino-5-benzylthio-1,2,4-thiazole as described in U.S. Pat. No. 4,123,274 and silver salts of thion compounds such as a silver salt of 3-(3-carboxyethyl)-4-methyl-4-thiazoline-2-thione as described in U.S. Pat. No. 3,301,678. Compounds containing an imino group may also be used. Preferred examples of these compounds include silver salts of benzotriazole and derivatives thereof, for example, silver salts of benzotriazoles such as silver methylbenzotriazole, silver salts of halogenated benzotriazoles such as silver 5-chlorobenzotriazole as well as silver salts of 1,2,4-triazole and 1-H-tetrazole and silver salts of imidazole and imidazole derivatives as described in U.S. Pat. No. 4,220,709. Also useful are various silver acetylide compounds as described, for example, in U.S. Pat. Nos. 4,761,361 and 4,775,613.

The organic silver salt which can be used herein may take any desired shape although needle crystals having a minor axis and a major axis are preferred. In the practice of the invention, grains should preferably have a minor axis of 0.01 $\mu$m to 0.20 $\mu$m, more preferably 0.01 $\mu$m to 0.15 $\mu$m and a major axis of 0.10 $\mu$m to 5.0 $\mu$m, more preferably 0.10 $\mu$m to 4.0 $\mu$m. The grain size distribution is desirably monodisperse. The monodisperse distribution means that a standard deviation of the length of minor and major axes divided by the length, respectively, expressed in percent, is preferably up to 100%, more preferably up to 80%, most preferably up to 50%. It can be determined from the measurement of the shape of organic silver salt grains using an image obtained through a transmission electron microscope. Another method for determining a monodisperse distribution is to determine a standard deviation of a volume weighed mean diameter. The standard deviation divided by the volume weighed mean diameter, expressed in percent, which is a coefficient of variation, is preferably up to 100%, more preferably up to 80%, most preferably up to 50%. It may be determined by irradiating laser light, for example, to organic silver salt grains dispersed in liquid and determining the autocorrelation function of the fluctuation of scattering light relative to a time change, and obtaining the grain size (volume weighed mean diameter) therefrom.

The organic silver salt used herein is preferably desalted. The desalting method is not critical. Any well-known method may be used although well-known filtration methods such as centrifugation, suction filtration, ultrafiltration, and flocculation/water washing are preferred.

In the practice of the invention, the organic silver salt is prepared into a solid microparticulate dispersion using a dispersant, in order to provide fine particles of small size and free of flocculation. A solid microparticulate dispersion of the organic silver salt may be prepared by mechanically dispersing the salt in the presence of dispersing aids by well-known comminuting means such as ball mills, vibrating ball mills, planetary ball mills, sand mills, colloidal mills, jet mills, and roller mills.

The dispersant used in the preparation of a solid microparticulate dispersion of the organic silver salt may be selected from synthetic anionic polymers such as polyacrylic acid, copolymers of acrylic acid, copolymers of maleic acid, copolymers of maleic acid monoester, and copolymers of acryloylmethylpropanesulfonic acid; semi-synthetic anionic polymers such as carboxymethyl starch and carboxymethyl cellulose; anionic polymers such as alginic acid and pectic acid; anionic surfactants as described in JP-A 92716/1977 and WO 88/04794; the compounds described in Japanese Patent Application No. 350753/1995; well-known anionic, nonionic and cationic surfactants; and well-known polymers such as polyvinyl alcohol, polyvinyl pyrrolidone, carboxymethyl cellulose, hydroxypropyl cellulose, and hydroxypropyl methyl cellulose, as well as naturally occurring high molecular weight compounds such as gelatin.

In general, the dispersant is mixed with the organic silver salt in powder or wet cake form prior to dispersion. The resulting slurry is fed into a dispersing machine. Alternatively, a mixture of the dispersant with the organic silver salt is subject to heat treatment or solvent treatment to form a dispersant-bearing powder or wet cake of the organic silver salt. It is acceptable to effect pH control with a suitable pH adjusting agent before, during or after dispersion.

Rather than mechanical dispersion, fine particles can be formed by roughly dispersing the organic silver salt in a solvent through pH control and thereafter, changing the pH in the presence of dispersing aids. An organic solvent can be used as the solvent for rough dispersion although the organic solvent is usually removed at the end of formation of fine particles.

The thus prepared dispersion may be stored while continuously stirring for the purpose of preventing fine particles from settling during storage. Alternatively, the dispersion is stored after adding hydrophilic colloid to establish a highly viscous state (for example, in a jelly-like state using gelatin). An antiseptic agent may be added to the dispersion in order to prevent the growth of bacteria during storage.

The organic silver salt is used in any desired amount, preferably about 0.1 to 5 g per square meter of the recording element, more preferably about 1 to 3 g/m$^2$.

Silver halide

When the thermographic image recording element of the invention is used as a photothermographic recording element, the element further contains a photosensitive silver halide. A method for forming the photosensitive silver halide is well known in the art. Any of the methods disclosed in Research Disclosure No. 17029 (June 1978) and U.S. Pat. No. 3,700,458, for example, may be used. Illustrative methods which can be used herein are a method of preparing an organic silver salt and adding a halogen-containing compound to the organic silver salt to convert a part of silver of the organic silver salt into photosensitive silver halide and a method of adding a silver-providing compound and a halogen-providing compound to a solution of gelatin or another polymer to form photosensitive silver halide grains and mixing the grains with an organic silver salt. The latter method is preferred in the practice of the invention. The photosensitive silver halide should preferably have a smaller mean grain size for the purpose of minimizing white turbidity after image formation. Specifically, the grain size is preferably up to 0.20 $\mu$m, more preferably 0.01 $\mu$m to 0.16 $\mu$m, most preferably 0.02 $\mu$m to 0.14 $\mu$m. The term grain size designates the length of an edge of a silver halide grain where silver halide grains are regular grains of cubic or octahedral shape. Where silver halide grains are tabular, the grain size is the diameter of an equivalent circle having the same area as the projected area of a major surface of a tabular grain. Where silver halide grains are not regular, for example, in the case of spherical or rod-shaped grains, the grain size is the diameter of an equivalent sphere having the same volume as a grain.

The shape of silver halide grains may be cubic, octahedral, tabular, spherical, rod-like and potato-like, with cubic and tabular grains being preferred in the practice of the invention. Where tabular silver halide grains are used, they should preferably have an average aspect ratio of from 100:1 to 2:1, more preferably from 50:1 to 3:1. Silver halide grains having rounded corners are also preferably used. No particular limit is imposed on the face indices (Miller indices) of an outer surface of photosensitive silver halide grains. Preferably silver halide grains have a high proportion of {100} face featuring high spectral sensitization efficiency upon adsorption of a spectral sensitizing dye. The proportion of {100} face is preferably at least 50%, more preferably at least 65%, most preferably at least 80%. Note that the proportion of Miller index {100} face can be determined by the method described in T. Tani, J. Imaging Sci., 29, 165 (1985), utilizing the adsorption dependency of {111} face and {100} face upon adsorption of a sensitizing dye.

The halogen composition of photosensitive silver halide is not critical and may be any of silver chloride, silver chlorobromide, silver bromide, silver iodobromide, silver iodochlorobromide, and silver iodide. The halogen composition in grains may have a uniform distribution or a non-uniform distribution wherein the halogen concentration changes in a stepped or continuous manner. Preferred are silver iodobromide grains having a higher silver iodide content in the interior. Silver halide grains of the core/shell structure are also useful. Such core/shell grains preferably have a multilayer structure of 2 to 5 layers, more preferably 2 to 4 layers.

Preferably the photosensitive silver halide grains used herein contain at least one complex of a metal selected from the group consisting of rhodium, rhenium, ruthenium, osmium, iridium, cobalt, mercury, and iron. The metal complexes may be used alone or in admixture of two or more complexes of a common metal or different metals. The metal complex is preferably contained in an amount of $1\times10^{-9}$ to $1\times10^{-2}$ mol, more preferably $1\times10^{-8}$ to $1\times10^{-4}$ mol per mol of silver. Illustrative metal complex structures are those described in JP-A 225449/1995. The cobalt and iron compounds are preferably hexacyano metal complexes while illustrative, non-limiting examples include ferricyanate, ferrocyanate, and hexacyanocobaltate ions. The distribution of the metal complex in silver halide grains is not critical. That is, the metal complex may be contained in silver halide grains to form a uniform phase or at a high concentration in either the core or the shell.

Photosensitive silver halide grains may be desalted by any of well-known water washing methods such as noodle and flocculation methods although silver halide grains may be either desalted or not according to the invention.

The photosensitive silver halide grains used herein should preferably be chemically sensitized. Preferred chemical sensitization methods are sulfur, selenium, and tellurium sensitization methods which are well known in the art. Also useful are a noble metal sensitization method using compounds of gold, platinum, palladium, and iridium and a reduction sensitization method. In the sulfur, selenium, and tellurium sensitization methods, any of compounds well known for the purpose may be used. For example, the compounds described in JP-A 128768/1995 are useful. Exemplary tellurium sensitizing agents include diacyltellurides, bis(oxycarbonyl)tellurides, bis-(carbamoyl) tellurides, bis(oxycarbonyl)ditellurides, bis(carbamoyl) ditellurides, compounds having a P═Te bond, tellurocarboxylic salts, Te-organyltellurocarboxylic esters, di(poly) tellurides, tellurides, telluroles, telluroacetals, tellurosulfonates, compounds having a P—Te bond, Te-containing heterocycles, tellurocarbonyl compounds, inorganic tellurium compounds, and colloidal tellurium. The preferred compounds used in the noble metal sensitization method include chloroauric acid, potassium chloroaurate, potassium aurithiocyanate, gold sulfide, and gold selenide as well as the compounds described in U.S. Pat. No. 2,448,060 and BP 618,061. Illustrative examples of the compound used in the reduction sensitization method include ascorbic acid, thiourea dioxide, stannous chloride, aminoiminomethanesulfinic acid, hydrazine derivatives, borane compounds, silane compounds, and polyamine compounds. Reduction sensitization may also be accomplished by ripening the emulsion while maintaining it at pH 7 or higher or at pAg 8.3 or lower. Reduction sensitization may also be accomplished by introducing a single addition portion of silver ion during grain formation.

According to the invention, the photosensitive silver halide is preferably used in an amount of 0.01 to 0.5 mol, more preferably 0.02 to 0.3 mol, most preferably 0.03 to 0.25 mol per mol of the organic silver salt. With respect to a method and conditions of admixing the separately prepared photosensitive silver halide and organic silver salt, there may be used a method of admixing the separately prepared photosensitive silver halide and organic silver salt in a high speed agitator, ball mill, sand mill, colloidal mill, vibrating mill or homogenizer or a method of preparing an organic silver salt by adding the already prepared photosensitive silver halide at any timing during preparation of an organic silver salt. Any desired mixing method may be used insofar as the benefits of the invention are fully achievable.

One of the preferred methods for preparing the silver halide according to the invention is a so-called halidation method of partially halogenating the silver of an organic silver salt with an organic or inorganic halide. Any of organic halides which can react with organic silver salts to form silver halides may be used. Exemplary organic halides are N-halogenoimides (e.g., N-bromosuccinimide), halogenated quaternary nitrogen compounds (e.g., tetrabutylammonium bromide), and aggregates of a halogenated quaternary nitrogen salt and a molecular halogen (e.g., pyridinium bromide perbromide). Any of inorganic halides which can react with organic silver salts to form silver halides may be used. Exemplary inorganic halides are alkali metal and ammonium halides (e.g., sodium chloride, lithium bromide, potassium iodide, and ammonium bromide), alkaline earth metal halides (e.g., calcium bromide and magnesium chloride), transition metal halides (e.g., ferric chloride and cupric bromide), metal complexes having a halogen ligand (e.g., sodium iridate bromide and ammonium rhodate chloride), and molecular halogens (e.g., bromine, chlorine and iodine). A mixture of organic and inorganic halides may also be used.

The amount of the halide added for the halidation purpose is preferably 1 mmol to 500 mmol, especially 10 mmol to 250 mmol of halogen atom per mol of the organic silver salt.

Reducing agent

The thermographic image forming element of the invention contains a reducing agent for the organic silver salt. The reducing agent for the organic silver salt may be any of substances, preferably organic substances, that reduce silver ion into metallic silver. Conventional photographic developing agents such as Phenidone®, hydroquinone and catechol are useful although hindered phenols are preferred reducing agents. The reducing agent should preferably be contained in an amount of 5 to 50 mol %, more preferably 10 to 40 mol % per mol of silver on the image forming layer-bearing side. The reducing agent may be added to any layer on the image forming layer-bearing side. Where the reducing agent is added to a layer other than the image forming layer, the reducing agent should preferably be contained in a slightly greater amount of about 10 to 50 mol % per mol of silver. The reducing agent may take the form of a precursor which is modified so as to exert its effective function only at the time of development.

For thermographic image recording elements using organic silver salts, a wide range of reducing agents are disclosed,.for example, in JP-A 6074/1971, 1238/1972, 33621/1972, 46427/1974, 115540/1974, 14334/1975, 36110/1975, 147711/1975, 32632/1976, 1023721/1976, 32324/1976, 51933/1976, 84727/1977, 108654/1980, 146133/1981, 82828/1982, 82829/1982, 3793/1994, U.S. Pat. Nos. 3,667,958, 3,679,426, 3,751,252, 3,751,255, 3,761,270, 3,782,949, 3,839,048, 3,928,686, 5,464,738, German Patent No. 2321328, and EP 692732. Exemplary reducing agents include amidoximes such as phenylamidoxime, 2-thienylamidoxime, and p-phenoxyphenyl-amidoxime; azines such as 4-hydroxy-3, 5-dimethoxy-benzaldehydeazine; combinations of aliphatic carboxylic acid arylhydrazides with ascorbic acid such as a combination of 2,2-bis(hydroxymethyl)propionyl-β-phenylhydrazine with ascorbic acid; combinations of polyhydroxybenzenes with hydroxylamine, reductone and/or hydrazine, such as combinations of hydroquinone with bis(ethoxyethyl)hydroxylamine, piperidinohexosereductone or formyl-4-methylphenyl-hydrazine; hydroxamic acids such as phenylhydroxamic acid, p-hydroxyphenylhydroxamic acid, and β-anilinehydroxamic acid; combinations of azines with sulfonamidophenols such as a combination of phenothiazine with 2,6-dichloro-4-benzenesulfonamidephenol; α-cyanophenyl acetic acid derivatives such as ethyl-α-cyano-2-methylphenyl acetate and ethyl-α-cyanophenyl acetate; bis-β-naphthols such as 2,2-dihydroxy-1,1-binaphthyl, 6,6'-dibromo-2,2'-dihydroxy-1,1'-binaphthyl, and bis(2-hydroxy-1-naphthyl) methane; combinations of bis-β-naphthols with 1,3-dihydroxybenzene derivatives such as 2,4-dihydroxybenzophenone and 2', 4'-dihydroxyacetophenone; 5-pyrazolones such as 3-methyl-1-phenyl-5-pyrazolone; reductones such as dimethylaminohexosereductone, anhydro-dihydroaminohexosereductone and anhydrodihydropiperidone-hexosereductone; sulfonamidephenol reducing agents such as 2,6-dichloro-4-benzenesulfonamidephenol and p-benzenesulfonamidephenol; 2-phenylindane-1,3-dione, etc.; chromans such as 2,2-dimethyl-7-t-butyl-6-hydroxychroman; 1,4-dihydropyridines such as 2,6-dimethoxy-3,5-dicarboethoxy-1,4-dihydropyridine; bisphenols such as bis(2-hydroxy-3-t-butyl-5-methylphenyl) methane, 2,2-bis(4-hydroxy-3-methylphenyl)propane, 4,4-ethylidene-bis(2-t-butyl-6-methylphenol), 1,1-bis(2-hydroxy-3,5-dimethylphenyl)-3,5,5-trimethylhexane, and 2,2-bis(3,5-dimethyl-4-hydroxyphenyl)-propane; ascorbic acid derivatives such as 1-ascorbyl palmitate and ascorbyl stearate; aldehydes and ketones such as benzil and diacetyl; 3-pyrazolidones and certain indane-1,3-diones; and chromanols (tocopherols). Preferred reducing agents are bisphenols and chromanols.

The reducing agent may be added in any desired form such as solution, powder or solid particle dispersion. The solid particle dispersion of the reducing agent may be prepared by well-known comminuting means such as ball mills, vibrating ball mills, sand mills, colloidal mills, jet mills, and roller mills. Dispersing aids may be used for facilitating dispersion.

Toner

A higher optical density is sometimes achieved when an additive known as a "toner" for improving images is contained. The toner is also sometimes advantageous in forming black silver images. The toner is preferably used in an amount of 0.1 to 50 mol %, especially 0.5 to 20 mol % per mol of silver on the image forming layer-bearing side. The toner may take the form of a precursor which is modified so as to exert its effective function only at the time of development.

For thermographic image recording elements using organic silver salts, a wide range of toners are disclosed, for example, in JP-A 6077/1971, 10282/1972, 5019/1974, 5020/1974, 91215/1974, 2524/1975, 32927/1975, 67132/1975, 67641/1975, 114217/1975, 3223/1976, 27923/1976, 14788/1977, 99813/1977, 1020/1978, 76020/1978, 156524/1979, 156525/1979, 183642/1986, and 56848/1992, JP-B 10727/1974 and 20333/1979, U.S. Pat. Nos. 3,080,254, 3,446,648, 3,782,941, 4,123,282, 4,510,236, BP 1,380,795, and Belgian Patent No. 841,910. Examples of the toner include phthalimide and N-hydroxyphthalimide; cyclic imides such as succinimide, pyrazolin-5-one, quinazolinone, 3-phenyl-2-pyrazolin-5-one, 1-phenylurazol, quinazoline and 2,4-thiazolizinedione; naphthalimides such as N-hydroxy-1,8-naphthalimide; cobalt complexes such as cobaltic hexamine trifluoroacetate; mercaptans as exemplified by 3-mercapto-1,2,4-triazole, 2,4-dimercapto-pyrimidine, 3-mercapto-4,5-diphenyl-1,2,4-triazole, and 2,5-dimercapto-1,3,4-thiadiazole; N-(aminomethyl)aryldicarboxyimides such as (N,N-dimethylaminomethyl)phthalimide and N,N-(dimethylaminomethyl)-naphthalene-2,3-dicarboxyimide; blocked pyrazoles, isothiuronium derivatives and certain photo-bleach agents such as N,N'-hexamethylenebis(1-carbamoyl-3,5-dimethylpyrazole), 1,8-(3,6-diazaoctane)-bis (isothiuroniumtrifluoroacetate) and 2-tribromomethylsulfonylbenzothiazole; 3-ethyl-5-{(3-ethyl-2-benzothiazolinylidene)-1-methylethylidene}-2-thio-2,4-oxazolidinedione; phthalazinone, phthalazinone derivatives or metal salts, or derivatives such as 4-(1-naphthyl)-phthalazinone, 6-chlorophthalazinone, 5,7-dimethoxyphthalazinone and 2,3-dihydro-1,4-phthalazinedione; combinations of phthalazinones with phthalic acid derivatives (e.g., phthalic acid, 4-methylphthalic acid, 4-nitrophthalic acid and tetrachlorophthalic anhydride); phthalazine, phthalazine derivatives or metal salts such as 4-(1-naphthyl)phthalazine, 6-chlorophthalazine, 5,7-dimethoxyphthalazine and 2,3-dihydrophthalazine; combinations of phthalazine with phthalic acid derivatives (e.g., phthalic acid, 4-methylphthalic acid, 4-nitrophthalic acid and tetrachlorophthalic anhydride); quinazolinedione, benzoxazine or naphthoxazine derivatives; rhodium complexes which function not only as a tone regulating agent, but also as a source of halide ion for generating silver halide in situ, for example, ammonium hexachlororhodinate (III), rhodium bromide, rhodium nitrate and potassium hexachlororhodinate (III); inorganic peroxides and persulfates such as ammonium peroxide disulfide and hydrogen peroxide; benzoxazine-2,4-diones such as 1,3-benzoxazine-2,4-dione, 8-methyl-1,3-benzoxazine-2,4-dione, and 6-nitro-1,3-benzoxazine-2,4-dione; pyrimidine and asym-triazines such as 2,4-dihydroxypyrimidine and 2-hydroxy-4-aminopyrimidine; azauracil and tetraazapentalene derivatives such as 3,6-dimercapto-1,4-diphenyl-1H,4H-2,3a,5,6a-tetraazapentalene, and 1,4-di(o-chlorophenyl)-3,6-dimercapto-1H,4H-2,3a,5,6a-tetraazapentalene.

The toner may be added in any desired form, for example, as a solution, powder and solid particle dispersion. The solid particle dispersion of the toner is prepared by well-known finely dividing means such as ball mills, vibrating ball mills, sand mills, colloid mills, jet mills, and roller mills. Dispersing aids may be used in preparing the solid particle dispersion.

Binder

The image forming layer used herein is usually based on a binder. Exemplary binders are naturally occurring polymers and synthetic resins, for example, gelatin, polyvinyl acetal, polyvinyl chloride, polyvinyl acetate, cellulose acetate, polyolefins, polyesters, polystyrene, polyacrylonitrile, and polycarbonate. Of course, copolymers and terpolymers are included. Preferred polymers are polyvinyl butyral, butylethyl cellulose, methacrylate copolymers, maleic anhydride ester copolymers, polystyrene and butadiene-styrene copolymers. These polymers may be used alone or in admixture of two or more as desired. The polymer is used in such a range that it may effectively function as a binder to carry various components. The effective range may be properly determined by those skilled in the art without undue experimentation. Taken at least as a measure for carrying the organic silver salt in the film, the weight ratio of the binder to the organic silver salt is preferably in the range of from 15:1 to 1:2, more preferably from 8:1 to 1:1.

At least one layer of the image-forming layers used herein may be an image forming layer wherein a polymer latex constitutes more than 50% by weight of the entire binder. This image forming layer is sometimes referred to as "inventive image-forming layer" and the polymer latex used as the binder therefor is referred to as "inventive polymer latex," hereinafter. The term "polymer latex" used herein is a dispersion of a microparticulate water-insoluble hydrophobic polymer in a water-soluble dispersing medium. With respect to the dispersed state, a polymer emulsified in a dispersing medium, an emulsion polymerized polymer, a micelle dispersion, and a polymer having a hydrophilic structure in a part of its molecule so that the molecular chain itself is dispersed on a molecular basis are included. With respect to the polymer latex, reference is made to Okuda and Inagaki Ed., "Synthetic Resin Emulsion," Kobunshi Kankokai, 1978; Sugimura, Kataoka, Suzuki and Kasahara Ed., "Application of Synthetic Latex," Kobunshi Kankokai, 1993; and Muroi, "Chemistry of Synthetic Latex," Kobunshi Kankokai, 1970. Dispersed particles should preferably have a mean particle size of about 1 to 50,000 nm, more preferably about 5 to 1,000 nm. No particular limit is imposed on the particle size distribution of dispersed particles, and the dispersion may have either a wide particle size distribution or a monodisperse particle size distribution.

The inventive polymer latex used herein may be either a latex of the conventional uniform structure or a latex of the so-called core/shell type. In the latter case, better results are sometimes obtained when the core and the shell have different glass transition temperatures.

The inventive polymer latex should preferably have a minimum film-forming temperature (MFT) of about −30° C. to 90° C., more preferably about 0° C. to 70° C. A film-forming aid may be added in order to control the minimum film-forming temperature. The film-forming aid is also referred to as a plasticizer and includes organic compounds (typically organic solvents) for lowering the minimum film-forming temperature of a polymer latex. It is described in Muroi, "Chemistry of Synthetic Latex," Kobunshi Kankokai, 1970.

Polymers used in the inventive polymer latex according to the invention include acrylic resins, vinyl acetate resins, polyester resins, polyurethane resins, rubbery resins, vinyl chloride resins, vinylidene chloride resins, polyolefin resins, and copolymers thereof. The polymer may be linear or branched or crosslinked. The polymer may be either a homopolymer or a copolymer having two or more monomers polymerized together. The copolymer may be either a random copolymer or a block copolymer. The polymer preferably has a number average molecule weight Mn of about 5,000 to about 1,000,000, more preferably about 10,000 to about 100,000. Polymers with a too lower molecular weight would generally provide a low film strength after coating whereas polymers with a too higher molecular weight are difficult to form films.

The polymer of the inventive polymer latex should preferably have an equilibrium moisture content at 25° C. and RH 60% of up to 2% by weight, more preferably up to 1% by weight. With respect to the definition and measurement of equilibrium moisture content, reference should be made to "Polymer Engineering Series No. 14, Polymer Material Test Methods," Edited by Japanese Polymer Society, Chijin Shokan Publishing K.K., for example.

Illustrative examples of the polymer latex which can be used as the binder in the image-forming layer of the thermographic image recording element of the invention include latices of methyl methacrylate/ethyl acrylate/methacrylic acid copolymers, latices of methyl methacrylate/2-ethylhexyl acrylate/styrene/acrylic acid copolymers, latices of styrene/butadiene/acrylic acid copolymers, latices of styrene/butadiene/divinyl benzene/methacrylic acid copolymers, latices of methyl methacrylate/vinyl chloride/acrylic acid copolymers, and latices of vinylidene chloride/ethyl acrylate/acrylonitrile/methacrylic acid copolymers. These polymers or polymer latices are commercially available. Exemplary acrylic resins are Sebian A-4635, 46583 and 4601 (Daicell Chemical Industry K.K.) and Nipol LX811, 814, 820, 821 and 857 (Nippon Zeon K.K.). Exemplary polyester resins are FINETEX ES650, 611, 675, and 850 (Dai-Nihon Ink Chemical K.K.) and WD-size and WMS (Eastman Chemical Products, Inc.). Exemplary polyurethane resins are HYDRAN AP10, 20, 30 and 40 (Dai-Nihon Ink Chemical K.K.). Exemplary rubbery resins are LACSTAR 7310K, 3307B, 4700H and 7132C (Dai-Nihon Ink Chemical K.K.) and Nipol LX416, 410, 438C and 2507 (Nippon Zeon K.K.). Exemplary vinyl chloride resins are G351 and G576 (Nippon Zeon K.K.). Exemplary vinylidene chloride resins are L502 and L513 (Asahi Chemicals K.K.). Exemplary olefin resins are Chemipearl S120 and SA100 (Mitsui Petro-Chemical K.K.). These polymers may be used alone or in admixture of two or more.

In the inventive image-forming layer, the polymer latex described above is preferably used in an amount of at least 50% by weight, especially at least 70% by weight, of the entire binder. In the inventive image-forming layer, a hydrophilic polymer may be added in an amount of less than 50% by weight of the entire binder. Such hydrophilic polymers are gelatin, polyvinyl alcohol, methyl cellulose, hydroxypropyl cellulose, carboxymethyl cellulose, and hydroxypropyl methyl cellulose. The amount of the hydrophilic polymer added is preferably less than 30% by weight of the entire binder in the image-forming layer.

The inventive image-forming layer is preferably formed by applying an aqueous coating solution followed by drying. By the term "aqueous", it is meant that water accounts for at least 30% by weight of the solvent or dispersing medium of the coating solution. The component other than water of the coating solution may be a water-miscible organic solvent such as methyl alcohol, ethyl alcohol, isopropyl alcohol, methyl cellosolve, ethyl cellosolve, dimethylformamide or ethyl acetate. Exemplary solvent compositions include water, a 90/10 or 70/30 mixture of water/methanol, a 90/10 mixture of water/ethanol, a 90/10 mixture of water/isopropanol, a 95/5 mixture of water/dimethyl-formamide, a 80/15/5 or 90/5/5 mixture of water/methanol/dimethylformamide, all expressed in a weight ratio.

The method described in U.S. Pat. No. 5,496,695 is also useful.

In the inventive image-forming layer, the total amount of binder is preferably 0.2 to 30 g/m$^2$, more preferably 1 to 15 g/m$^2$ per layer. To the image forming layer, crosslinking agents for crosslinking, surfactants for ease of application, and other addenda may be added.

Sensitizing dye

A sensitizing dye may be used in the practice of the invention. There may be used any of sensitizing dyes which can spectrally sensitize silver halide grains in a desired wavelength region when adsorbed to the silver halide grains. The sensitizing dyes used herein include cyanine dyes, merocyanine dyes, complex cyanine dyes, complex merocyanine dyes, holopolar cyanine dyes, styryl dyes, hemicyanine dyes, oxonol dyes, and hemioxonol dyes. Useful sensitizing dyes which can be used herein are described in Research Disclosure, Item 17643 IV-A (December 1978, page 23), ibid., Item 1831 X (August 1979, page 437) and the references cited therein. It is advantageous to select a sensitizing dye having appropriate spectral sensitivity to the spectral properties of a particular light source of various laser imagers, scanners, image setters and printing plate-forming cameras.

Exemplary dyes for spectral sensitization to red light include compounds I-1 to I-38 described in JP-A 18726/1979, compounds I-1 to I-35 described in JP-A 75322/1994, compounds I-1 to I-34 described in JP-A 287338/1995, dyes 1 to 20 described in JP-B 39818/1980, compounds I-1 to I-37 described in JP-A 284343/1987, and compounds I-1 to I-34 described in JP-A 287338/1995 for red light sources such as He—Ne lasers, red semiconductor lasers and LED.

For semiconductor laser light sources in the wavelength range of 750 to 1,400 nm, spectral sensitization may be advantageously done with various known dyes including cyanine, merocyanine, styryl, hemicyanine, oxonol, hemioxonol, and xanthene dyes. Useful cyanine dyes are cyanine dyes having a basic nucleus such as a thiazoline, oxazoline, pyrroline, pyridine, oxazole, thiazole, selenazole and imidazole nucleus. Preferred examples of the useful merocyanine dye contain an acidic nucleus such as a thiohydantoin, rhodanine, oxazolidinedione, thiazolinedione, barbituric acid, thiazolinone, malononitrile, and pyrazolone nucleus in addition to the above-mentioned basic nucleus. Among the above-mentioned cyanine and merocyanine dyes, those having an imino or carboxyl group are especially effective. A suitable choice may be made of well-known dyes as described, for example, in U.S. Pat. No. 3,761,279, 3,719,495, and 3,877,943, BP 1,466,201, 1,469,117, and 1,422,057, JP-B 10391/1991 and 52387/1994, JP-A 341432/1993, 194781/1994, and 301141/1994.

Especially preferred dye structures are cyanine dyes having a thioether bond-containing substituent group, examples of which are the cyanine dyes described in JP-A 58239/1987, 138638/1991, 138642/1991, 255840/1992, 72659/1993, 72661/1993, 222491/1994, 230506/1990, 258757/1994, 317868/1994, and 324425/1994, Publication of International Patent Application No. 500926/1995, and U.S. Pat. No. 5,541,054; dyes having a carboxylic group, examples of which are the dyes described in JP-A 163440/1991, 301141/1994 and U.S. Pat. No. 5,441,899; and merocyanine dyes, polynuclear merocyanine dyes, and polynuclear cyanine dyes, examples of which are the dyes described in JP-A 6329/1972, 105524/1974, 127719/1976, 80829/1977, 61517/1979, 214846/1984, 6750/1985, 159841/1988, 35109/1994, 59381/1994, 146537/1995, Publication of International Patent Application No. 50111/1993, BP 1,467,638, and U.S. Pat. No. 5,281,515.

Also useful in the practice of the invention are dyes capable of forming the J-band as disclosed in U.S. Pat. Nos. 5,510,236, 3,871,887 (Example 5), JP-A 96131/1990 and 48753/1984.

These sensitizing dyes may be used alone or in admixture of two or more. A combination of sensitizing dyes is often used for the purpose of supersensitization. In addition to the sensitizing dye, the emulsion may contain a dye which itself has no spectral sensitization function or a compound which does not substantially absorb visible light, but is capable of supersensitization. Useful sensitizing dyes, combinations of dyes showing supersensitization, and compounds showing supersensitization are described in Research Disclosure, Vol. 176, 17643 (December 1978), page 23, IV J and JP-B 25500/1974 and 4933/1968, JP-A 19032/1984 and 192242/1984.

The sensitizing dye may be added to a silver halide emulsion by directly dispersing the dye in the emulsion or by dissolving the dye in a solvent and adding the solution to the emulsion. The solvent used herein includes water, methanol, ethanol, propanol, acetone, methyl cellosolve, 2,2,3,3-tetrafluoropropanol, 2,2,2-trifluoroethanol, 3-methoxy-1-propanol, 3-methoxy-1-butanol, 1-methoxy-2-propanol, N,N-dimethylformamide and mixtures thereof.

Also useful are a method of dissolving a dye in a volatile organic solvent, dispersing the solution in water or hydrophilic colloid and adding the dispersion to an emulsion as disclosed in U.S. Pat. No. 3,469,987, a method of dissolving a dye in an acid and adding the solution to an emulsion or forming an aqueous solution of a dye with the aid of an acid or base and adding it to an emulsion as disclosed in JP-B 23389/1969, 27555/1969 and 22091/1982, a method of forming an aqueous solution or colloidal dispersion of a dye with the aid of a surfactant and adding it to an emulsion as disclosed in U.S. Pat. Nos. 3,822,135 and 4,006,025, a method of directly dispersing a dye in hydrophilic colloid and adding the dispersion to an emulsion as disclosed in JP-A 102733/1978 and 105141/1983, and a method of dissolving a dye using a compound capable of red shift and adding the solution to an emulsion as disclosed in JP-A 74624/1976. It is also acceptable to apply ultrasonic waves to form a solution.

The time when the sensitizing dye is added to the silver halide emulsion according to the invention is at any step of an emulsion preparing process which has been ascertained effective. The sensitizing dye may be added to the emulsion at any stage or step before the emulsion is coated, for example, at a stage prior to the silver halide grain forming step and/or desalting step, during the desalting step and/or a stage from desalting to the start of chemical ripening as disclosed in U.S. Pat. Nos. 2,735,766, 3,628,960, 4,183,756, and 4,225,666, JP-A 184142/1983 and 196749/1985, and a stage immediately before or during chemical ripening and a stage from chemical ripening to emulsion coating as disclosed in JP-A 113920/1983. Also as disclosed in U.S. Pat. No. 4,225,666 and JP-A 7629/1983, an identical compound may be added alone or in combination with a compound of different structure in divided portions, for example, in divided portions during a grain forming step and during a chemical ripening step or after the completion of chemical ripening, or before or during chemical ripening and after the completion thereof. The type of compound or the combination of compounds to be added in divided portions may be changed.

The amount of the sensitizing dye used may be an appropriate amount complying with sensitivity and fog although the preferred amount is about $10^{-6}$ to 1 mol, more preferably $10^{-4}$ to $10^{-1}$ mol per mol of the silver halide in the image forming layer.

Antifoggant

With antifoggants, stabilizers and stabilizer precursors, the silver halide emulsion and/or organic silver salt according to the invention can be further protected against formation of additional fog and stabilized against lowering of sensitivity during shelf storage. Suitable antifoggants, stabilizers and stabilizer precursors which can be used alone or in combination include thiazonium salts as described in U.S. Pat. Nos. 2,131,038 and 2,694,716, azaindenes as described in U.S. Pat. Nos. 2,886,437 and 2,444,605, mercury salts as described in U.S. Pat. No. 2,728,663, urazoles as described in U.S. Pat. No. 3,287,135, sulfocatechols as described in U.S. Pat. No. 3,235,652, oximes, nitrons and nitroindazoles as described in BP 623,448, polyvalent metal salts as described in U.S. Pat. No. 2,839,405, thiuronium salts as described in U.S. Pat. No. 3,220,839, palladium, platinum and gold salts as described in U.S. Pat. Nos. 2,566,263 and 2,597,915, halogen-substituted organic compounds as described in U.S. Pat. Nos. 4,108,665 and 4,442,202, triazines as described in U.S. Pat. Nos. 4,128,557, 4,137,079, 4,138,365 and 4,459,350, and phosphorus compounds as described in U.S. Pat. No. 4,411,985.

Preferred antifoggants are organic halides, for example, the compounds described in JP-A 119624/1975, 120328/1975, 121332/1976, 58022/1979, 70543/1981, 99335/1981, 90842/1984, 129642/1986, 129845/1987, 208191/1994, 5621/1995, 2781/1995, 15809/1996, U.S. Pat. Nos. 5,340,712, 5,369,000, and 5,464,737.

The antifoggant may be added in any desired form such as solution, powder or solid particle dispersion. The solid particle dispersion of the antifoggant may be prepared by well-known comminuting means such as ball mills, vibrating ball mills, sand mills, colloidal mills, jet mills, and roller mills. Dispersing aids may be used for facilitating dispersion.

It is sometimes advantageous to add a mercury (II) salt to an emulsion layer as an antifoggant though not necessary in the practice of the invention. Mercury (II) salts preferred to this end are mercury acetate and mercury bromide. The mercury (II) salt is preferably added in an amount of $1\times10^{-9}$ mol to $1\times10^{-3}$ mol, more preferably $1\times10^{-8}$ mol to $1\times10^{-4}$ mol per mol of silver coated.

Still further, the thermographic image recording element of the invention may contain a benzoic acid type compound for the purposes of increasing sensitivity and restraining fog. Any of benzoic acid type compounds may be used although examples of the preferred structure are described in U.S. Pat. Nos. 4,784,939 and 4,152,160, Japanese Patent Application Nos. 98051/1996, 151241/1996, and 151242/1996. The benzoic acid type compound may be added to any site in the image recording element, preferably to a layer on the same side as the photosensitive layer serving as the image forming layer, and more preferably an organic silver salt-containing layer. The benzoic acid type compound may be added at any step in the preparation of a coating solution. Where it is contained in an organic silver salt-containing layer, it may be added at any step from the preparation of the organic silver salt to the preparation of a coating solution, preferably after the preparation of the organic silver salt and immediately before coating. The benzoic acid type compound may be added in any desired form including powder, solution and fine particle dispersion. Alternatively, it may be added in a solution form after mixing it with other additives such as a sensitizing dye, reducing agent and toner. The benzoic acid type compound may be added in any desired amount, preferably $1\times10^{-6}$ mol to 2 mol, more preferably $1\times10^{-3}$ mol to 0.5 mol per mol of silver.

In the imaging element of the invention, mercapto, disulfide and thion compounds may be added for the purposes of retarding or accelerating development to control development, improving spectral sensitization efficiency, and improving storage stability before and after development.

Where mercapto compounds are used herein, any structure is acceptable. Preferred are structures represented by Ar-S-M and Ar-S-S-Ar wherein M is a hydrogen atom or alkali metal atom, and Ar is an aromatic ring or fused aromatic ring having at least one nitrogen, sulfur, oxygen, selenium or tellurium atom. Preferred hetero-aromatic rings are benzimidazole, naphthimidazole, benzothiazole, naphthothiazole, benzoxazole, naphthoxazole, benzoselenazole, benzotellurazole, imidazole, oxazole, pyrrazole, triazole, thiadiazole, tetrazole, triazine, pyrimidine, pyridazine, pyrazine, pyridine, purine, quinoline and quinazolinone rings. These hetero-aromatic rings may have a substituent selected from the group consisting of halogen (e.g., Br and Cl), hydroxy, amino, carboxy, alkyl groups (having at least 1 carbon atom, preferably 1 to 4 carbon atoms), and alkoxy groups (having at least 1 carbon atom, preferably 1 to 4 carbon atoms). Illustrative, non-limiting examples of the mercapto-substituted hetero-aromatic compound include 2-mercaptobenzimidazole, 2-mercaptobenzoxazole, 2-mercaptobenzothiazole, 2-mercapto-5-methylbenzimidazole, 6-ethoxy-2-mercaptobenzothiazole, 2,2'-dithiobis(benzothiazole), 3-mercapto-1,2,4-triazole, 4,5-diphenyl-2-imidazolethiol, 2-mercaptoimidazole, 1-ethyl-2-mercaptobenzimidazole, 2-mercaptoquinoline, 8-mercaptopurine, 2-mercapto-4(3H)-quinazolinone, 7-trifluoromethyl-4-quinolinethiol, 2,3,5,6-tetrachloro-4-pyridinethiol, 4-amino-6-hydroxy-2-mercaptopyrimidine monohydrate, 2-amino-5-mercapto-1,3,4-thiadiazole, 3-amino-5-mercapto-1,2,4-triazole, 4-hydroxy-2-mercaptopyrimidine, 2-mercaptopyrimidine, 4,6-diamino-2-mercaptopyrimidine, 2-mercapto-4-methylpyrimidine hydrochloride, 3-mercapto-5-phenyl-1,2,4-triazole, and 2-mercapto-4-phenyloxazole.

These mercapto compounds are preferably added to the emulsion layer (serving as the image forming layer) in amounts of 0.001 to 1.0 mol, more preferably 0.01 to 0.3 mol per mol of silver.

In the image recording layer, polyhydric alcohols (e.g., glycerin and diols as described in U.S. Pat. No. 2,960,404), fatty acids and esters thereof as described in U.S. Pat. Nos. 2,588,765 and 3,121,060, and silicone resins as described in BP 955,061 may be added as a plasticizer and lubricant.

Protective layer

A surface protective layer may be provided in the image recording element according to the present invention for the purpose of preventing sticking of the image forming layer.

The surface protective layer is based on a binder which may be any desired polymer, although the layer preferably contains 100 mg/m$^2$ to 5 g/m$^2$ of a polymer having a carboxylic acid residue. The polymers having a carboxylic acid residue include natural polymers (e.g., gelatin and alginic acid), modified natural polymers (e.g., carboxymethyl cellulose and phthalated gelatin), and synthetic polymers (e.g., polymethacrylate, polyacrylate, polyalkyl methacrylate/acrylate copolymers, and polystyrene/polymethacrylate copolymers). The content of the carboxylic acid residue is preferably 10 mmol to 1.4 mol per 100 grams of the polymer. The carboxylic acid residue may form a salt with an alkali metal ion, alkaline earth metal ion or organic cation.

In the surface protective layer, any desired anti-sticking material may be used. Examples of the anti-sticking material include wax, silica particles, styrene-containing elastomeric block copolymers (e.g., styrene-butadiene-styrene and styrene-isoprene-styrene), cellulose acetate, cellulose acetate butyrate, cellulose propionate and mixtures thereof. Crosslinking agents for crosslinking, surfactants for ease of application, and other addenda are optionally added to the surface protective layer.

In the image forming layer or a protective layer therefor according to the invention, there may be used light absorbing substances and filter dyes as described in U.S. Pat. Nos. 3,253,921, 2,274,782, 2,527,583, and 2,956,879. The dyes may be mordanted as described in U.S. Pat. No. 3,282,699. The filer dyes are used in such amounts that the layer may have an absorbance of 0.1 to 3, especially 0.2 to 1.5 at the exposure wavelength.

In the image forming layer or a protective layer therefor according to the invention, there may be used matte agents, for example, starch, titanium dioxide, zinc oxide, and silica as well as polymer beads including beads of the type described in U.S. Pat. Nos. 2,992,101 and 2,701,245. The image forming or protective layer surface may have any degree of matte insofar as no star dust failures occur although a Bekk smoothness of 200 to 10,000 seconds, especially 300 to 10,000 seconds is preferred.

The thermographic photographic emulsion used in the photothermographic imaging material according to the one preferred embodiment of the invention is contained in one or more layers on a support. In the event of single layer construction, it should contain an organic silver salt, silver halide, developing agent, and binder, and other optional additives such as a toner, coating aid and other auxiliary agents. In the event of two-layer construction, a first emulsion layer which is generally a layer disposed adjacent to the support should contain an organic silver salt and silver halide and a second emulsion layer or both the layers contain other components. Also envisioned herein is a two-layer construction consisting of a single emulsion layer containing all the components and a protective topcoat. In the case of multi-color sensitive photothermographic material, a combination of such two layers may be employed for each color. Also a single layer may contain all necessary components as described in U.S. Pat. No. 4,708,928. In the case of multi-dye, multi-color sensitive photothermographic material, emulsion (or photosensitive) layers are distinctly supported by providing a functional or non-functional barrier layer therebetween as described in U.S. Pat. No. 4,460,681.

In the image recording layer, a variety of dyes and pigments may be used from the standpoints of improving tone and preventing irradiation. Any desired dyes and pigments may be used in the invention. Useful pigments and dyes include those described in Colour Index and both organic and inorganic, for example, pyrazoloazole dyes, anthraquinone dyes, azo dyes, azomethine dyes, oxonol dyes, carbocyanine dyes, styryl dyes, triphenylmethane dyes, indoaniline dyes, indophenol dyes, and phthalocyanine dyes. The preferred dyes used herein include anthraquinone dyes (e.g., Compounds 1 to 9 described in JP-A 341441/1993 and Compounds 3-6 to 3-18 and 3-23 to 3-38 described in JP-A 165147/1993), azomethine dyes (e.g., Compounds 17 to 47 described in JP-A 341441/1993), indoaniline dyes (e.g., Compounds 11 to 19 described in JP-A 289227/1993, Compound 47 described in JP-A 341441/1993 and Compounds 2-10 to 2-11 described in JP-A 165147/1993), and azo dyes (e.g., Compounds 10 to 16 described in JP-A 341441/1993). The dyes and pigments may be added in any desired form such as solution, emulsion or solid particle dispersion or in a form mordanted with polymeric mordants. The amounts of these compounds used are determined in accordance with the desired absorption although the compounds are generally used in amounts of 1 $\mu$g to 1 g per square meter of the imaging element.

In the practice of the invention, an antihalation layer may be disposed on the side of the image recording layer remote from the light source. The antihalation layer preferably has a maximum absorbance of 0.1 to 2 in the desired wavelength range, more preferably an absorbance of 0.2 to 1.5 at the exposure wavelength, and an absorbance of 0.001 to less than 0.2 in the visible region after processing, and is also preferably a layer having an optical density of 0.001 to less than 0.15.

Where an antihalation dye is used in the invention, it may be selected from various compounds insofar as it has the desired absorption in the wavelength range, is sufficiently low absorptive in the visible region after processing, and provides the antihalation layer with the preferred absorbance profile. Exemplary antihalation dyes are given below though the dyes are not limited thereto. Useful dyes which are used alone are described in JP-A 56458/1984, 216140/1990, 13295/1995, 11432/1995, U.S. Pat. No. 5,380,635, JP-A 68539/1990, page 13, lower-left column, line 1 to page 14, lower-left column, line 9, and JP-A 24539/1991, page 14, lower-left column to page 16, lower-right column. It is further preferable in the practice of the invention to use a dye which will decolorize during processing. Illustrative, non-limiting, examples of decolorizable dyes are disclosed in JP-A 139136/1977, 132334/1978, 501480/1981, 16060/1982, 68831/1982, 101835/1982, 182436/1984, 36145/1995, 199409/1995, JP-B 33692/1973, 16648/1975, 41734/1990, U.S. Pat. Nos. 4,088,497, 4,283,487, 4,548,896, and 5,187,049.

In one preferred embodiment, the photographic thermographic image recording element of the invention is a one-side imaging element having at least one image forming layer on one side and a back layer on the other side of the support.

In the practice of the invention, a matte agent may be added to the one-side imaging element for improving feed efficiency. The matte agents used herein are generally microparticulate water-insoluble organic or inorganic compounds. There may be used any desired one of matte agents, for example, well-known matte agents including organic matte agents as described in U.S. Pat. Nos. 1,939,213, 2,701,245, 2,322,037, 3,262,782, 3,539,344, and 3,767,448 and inorganic matte agents as described in U.S. Pat. Nos. 1,260,772, 2,192,241, 3,257,206, 3,370,951, 3,523,022, and 3,769,020. Illustrative examples of the organic compound which can be used as the matte agent are given below; exemplary water-dispersible vinyl polymers include polymethyl acrylate, polymethyl methacrylate, polyacrylonitrile, acrylonitrile-α-methylstyrene copolymers, polystyrene, styrene-divinylbenzene copolymers, polyvinyl acetate, polyethylene carbonate, and polytetrafluoroethylene; exemplary cellulose derivatives include methyl cellulose, cellulose acetate, and cellulose acetate propionate; exemplary starch derivatives include carboxystarch, carboxynitrophenyl starch, urea-formaldehyde-starch reaction products, gelatin hardened with well-known curing agents, and hardened gelatin which has been coaceruvation hardened into microcapsulated hollow particles. Preferred examples of the inorganic compound which can be used as the matte agent include silicon dioxide, titanium dioxide, magnesium dioxide, aluminum oxide, barium sulfate, calcium carbonate, silver chloride and silver bromide desensitized by a well-known method, glass, and diatomaceous earth. The aforementioned matte agents may be used as a mixture of substances of different types if necessary. The size and shape of the matte agent are not critical. The matte agent of any particle size may be used although matte agents having a particle size of 0.1 μm to 30 μm are preferably used in the practice of the invention. The particle size distribution of the matte agent may be either narrow or wide. Nevertheless, since the haze and surface luster of photosensitive material are largely affected by the matte agent, it is preferred to adjust the particle size, shape and particle size distribution of a matte agent as desired during preparation of the matte agent or by mixing plural matte agents.

In the practice of the invention, the back layer should preferably have a degree of matte as expressed by a Bekk smoothness of 10 to 250 seconds, more preferably 50 to 180 seconds.

In the imaging element of the invention, the matte agent is preferably contained in an outermost surface layer, a layer functioning as an outermost surface layer, a layer close to the outer surface or a layer functioning as a so-called protective layer.

In the practice of the invention, the binder used in the back layer is preferably transparent or translucent and generally colorless. Exemplary binders are naturally occurring polymers, synthetic resins, polymers and copolymers, and other film-forming media, for example, gelatin, gum arabic, poly(vinyl alcohol), hydroxyethyl cellulose, cellulose acetate, cellulose acetate butyrate, poly(vinyl pyrrolidone), casein, starch, poly(acrylic acid), poly(methyl methacrylate), polyvinyl chloride, poly-(methacrylic acid), copoly(styrene-maleic anhydride), copoly(styrene-acrylonitrile), copoly(styrene-butadiene), polyvinyl acetals (e.g., polyvinyl formal and polyvinyl butyral), polyesters, polyurethanes, phenoxy resins, poly(vinylidene chloride), polyepoxides, polycarbonates, poly(vinyl acetate), cellulose esters, and polyamides. The binder may be dispersed in water, organic solvent or emulsion to form a dispersion which is coated to form a layer.

The back layer preferably exhibits a maximum absorbance of 0.3 to 2, more preferably 0.5 to 2 in the predetermined wavelength range and an absorbance of 0.001 to less than 0.5 in the visible range after processing. Further preferably, the back layer has an optical density of 0.001 to less than 0.3. Examples of the antihalation dye used in the back layer are the same as previously described for the antihalation layer.

A backside resistive heating layer as described in U.S. Pat. Nos. 4,460,681 and 4,374,921 may be used in a photographic thermographic image recording system according to the present invention.

According to the invention, a hardener may be used in various layers including an image forming layer, protective layer, and back layer. Examples of the hardener include polyisocyanates as described in U.S. Pat. No. 4,281,060 and JP-A 208193/1994, epoxy compounds as described in U.S. Pat. No. 4,791,042, and vinyl sulfones as described in JP-A 89048/1987.

A surfactant may be used for the purposes of improving coating and electric charging properties. The surfactants used herein may be nonionic, anionic, cationic and fluorinated ones. Examples include fluorinated polymer surfactants as described in JP-A 170950/1987 and U.S. Pat. No. 5,380,644, fluorinated surfactants as described in JP-A 244945/1985 and 188135/1988, polysiloxane surfactants as described in U.S. Pat. No. 3,885,965, and polyalkylene oxide and anionic surfactants as described in JP-A 301140/1994.

Examples of the solvent used herein are described in "New Solvent Pocket Book," Ohm K. K., 1994, though not limited thereto. The solvent used herein should preferably have a boiling point of 40 to 180° C. Exemplary solvents include hexane, cyclohexane, toluene, methanol, ethanol, isopropanol, acetone, methyl ethyl ketone, ethyl acetate, 1,1,1-trichloroethane, tetrahydrofuran, triethylamine, thiophene, trifluoroethanol, perfluoropentane, xylene, n-butanol, phenol, methyl isobutyl ketone, cyclohexanone, butyl acetate, diethyl carbonate, chlorobenzene, dibutyl ether, anisole, ethylene glycol diethyl ether, N,N-dimethylformamide, morpholine, propanesultone, perfluorotributylamine, and water.

Support

According to the invention, the thermographic emulsion may be coated on a variety of supports. Typical supports include polyester film, subbed polyester film, poly(ethylene terephthalate) film, polyethylene naphthalate film, cellulose nitrate film, cellulose ester film, poly(vinyl acetal) film, polycarbonate film and related or resinous materials, as well as glass, paper, metals, etc. Often used are flexible substrates, typically paper supports, specifically baryta paper and paper supports coated with partially acetylated α-olefin polymers, especially polymers of α-olefins having 2 to 10 carbon atoms such as polyethylene, polypropylene, and ethylene-butene copolymers. The supports are either transparent or opaque, preferably transparent.

The image recording element of the invention may have an antistatic or electroconductive layer, for example, a layer containing soluble salts (e.g., chlorides and nitrates), an evaporated metal layer, or a layer containing ionic polymers as described in U.S. Pat. Nos. 2,861,056 and 3,206,312 or insoluble inorganic salts as described in U.S. Pat. No. 3,428,451.

A method for producing color images using the photothermographic material of the invention is as described in JP-A 13295/1995, page 10, left column, line 43 to page 11, left column, line 40. Stabilizers for color dye images are exemplified in BP 1,326,889, U.S. Pat. Nos. 3,432,300, 3,698,909, 3,574,627, 3,573,050, 3,764,337, and 4,042,394.

In the practice of the invention, the thermographic emulsion can be applied by various coating procedures including dip coating, air knife coating, flow coating, and extrusion coating using a hopper of the type described in U.S. Pat. No. 2,681,294. If desired, two or more layers may be concurrently coated by the methods described in U.S. Pat. Nos. 2,761,791 and BP 837,095.

In the thermographic photographic element of the invention, there may be contained additional layers, for example, a dye accepting layer for accepting a mobile dye image, an opacifying layer when reflection printing is desired, a protective topcoat layer, and a primer layer well known in the photothermographic art. The photosensitive material of the invention is preferably such that only a single sheet of the photosensitive material can form an image. That is, it is preferred that a functional layer necessary to form an image such as an image receiving layer does not constitute a separate member.

The image recording element of the invention may be developed by any desired method although it is generally developed by heating after imagewise exposure. The preferred developing temperature is about 80 to 250° C., more preferably 100 to 140° C. The preferred developing time is about 1 to 180 seconds, more preferably about 10 to 90 seconds.

Any desired technique may be used for the exposure of the thermographic image recording element of the invention. The preferred light source for exposure is a laser, for example, a gas laser, YAG laser, dye laser or semiconductor laser. A semiconductor laser combined with a second harmonic generating device is also useful.

Where the thermographic image recording element of the invention does not contain the photosensitive silver halide, latent images can be formed by heating. Heating may be effected by various ways, for example, by direct heating using a thermal head. Indirect heating is also possible if a substance (e.g., a dyestuff or pigment) capable of absorbing radiation of a specific wavelength and converting it into heat is incorporated in the recording element. The light source used in this embodiment is preferably a laser as mentioned above. A combination of these techniques is possible. Where a latent image is formed by heating, the process may involve two stages, a first stage of heating to form a latent image and a second stage of heating to form an image. A single stage of heating can complete image formation.

EXAMPLE

Examples of the invention are given below by way of illustration and not by way of limitation.

The trade names used in Examples have the following meaning.

Denka Butyral: polyvinyl butyral by Denki Kagaku Kogyo K.K. CAB 171-15S: cellulose acetate butyrate by Eastman Chemical Products, Inc.

Sildex: spherical silica by Dokai Chemical K.K.

Sumidur N3500: polyisocyanate by Sumitomo-Bayern Urethane K.K.

Megafax F-176P: fluorinated surfactant by Dai-Nippon Ink Chemicals K.K.

LACSTAR 3307B: styrene-butadiene rubber (SBR) latex by Dai-Nippon Ink Chemicals K.K.

Example 1

Preparation of organic acid silver emulsion A

To 12 liters of water were added 840 grams of behenic acid and 95 grams of stearic acid. To the solution kept at 90° C., a solution of 48 grams of sodium hydroxide and 63 grams of sodium carbonate in 1.5 liters of water was added. The solution was stirred for 30 minutes and then cooled to 50° C. whereupon 1.1 liters of a 1% aqueous solution of N-bromosuccinimide was added. With stirring, 2.3 liters of a 17% aqueous solution of silver nitrate was slowly added. While the solution was kept at 35° C., with stirring, 1.5 liters of a 2% aqueous solution of potassium bromide was added over 2 minutes. The solution was stirred for 30 minutes whereupon 2.4 liters of a 1% aqueous solution of N-bromosuccinimide was added. With stirring, 3,300 grams of a solution containing 1.2% by weight of polyvinyl acetate in butyl acetate was added to the aqueous mixture. The mixture was allowed to stand for 10 minutes, separating into two layers. After the aqueous layer was removed, the remaining gel was washed twice with water. There was obtained a gel-like mixture of silver behenate/stearate and silver bromide, which was dispersed in 1,800 grams of a 2.6% 2-butanone solution of polyvinyl butyral (Denka Butyral #3000-K). The dispersion was further dispersed in 600 grams of polyvinyl butyral (Denka Butyral #4000-2) and 300 grams of isopropyl alcohol, obtaining an organic acid silver salt emulsion of needle grains having a mean minor diameter of 0.05 $\mu$m, a mean major diameter of 1.2 $\mu$m, and a coefficient of variation of 25%.

Preparation of emulsion layer coating solution A

With stirring at 25° C., the following chemicals were added to the above-prepared organic acid silver salt emulsion A in amounts per mol of silver. With stirring, 10 mg of sodium phenylthiosulfonate, 40 mg of Sensitizing Dye A, 8 mg of Sensitizing Dye B, 2 grams of 2-mercapto-5-methylbenzimidazole (C-1), 1 gram of 2-mercapto-5-methylbenzothiazole (C-2), 21.5 grams of 4-chlorobenzophenone-2-carboxylic acid (C-3), 580 grams of 2-butanone and 220 grams of dimethylformamide were added to the emulsion, which was allowed to stand for 3 hours. With stirring, 4.5 grams of 4,6-ditrichloromethyl-2-phenyltriazine (C-4), 2 grams of Disulfide compound A, 160 grams of 1,1-bis(2-hydroxy-3,5-dimethylphenyl)-3,5,5-trimethylhexane (C-5), 15 grams of phthalazine (C-6), 5 grams of tetrachlorophthalic acid (C-7), an amount as shown in Table 9 of a hydrazine derivative within or outside the scope of the invention, 1.1 grams of fluorinated surfactant Megafax F-176P, 590 grams of 2-butanone, and 10 grams of methyl isobutyl ketone were added to the emulsion.

Preparation of emulsion surface protective layer coating solution A

A coating solution A for an emulsion layer surface protective layer was prepared by dissolving 75 grams of cellulose acetate butyrate CAB 171-15S, 5.7 grams of 4-methylphthalic acid (C-8), 1.5 grams of tetrachlorophthalic anhydride (C-9), 10 grams of 2-tribromomethylsulfonyl-benzothiazole (C-10), 2 grams of phthalazone (C-11), 0.3 gram of Megafax F-176P, 2 grams of Sildex H31 (spherical silica, 3 μm), and 5 grams of polyisocyanate Sumidur N3500 in 3070 grams of 2-butanone and 30 grams of ethyl acetate.

Preparation of coated sample

A back layer coating solution was prepared by adding 6 grams of polyvinyl butyral Denka Butyral #4000-2, 0.2 gram of spherical silica Sildex H121 (mean size 12 μm), 0.2 gram of spherical silica Sildex H51 (mean size 5 μm), and 0.1 gram of Megafax F-176P to 64 grams of 2-propanol and mixing them into a solution. Further, a mixed solution of 420 mg of Dyestuff A in 10 grams of methanol and 20 grams of acetone and a solution of 0.8 gram of 3-isocyanatomethyl-3,5,5-trimethylhexyl isocyanate in 6 grams of ethyl acetate were added to the solution.

A polyethylene terephthalate film having a moisture-proof undercoat of vinylidene chloride on either surface was coated on one surface with the back surface coating solution so as to give an optical density of 0.7 at 780 nm.

On the thus prepared support, the emulsion layer coating solution was coated so as to give a coverage of 2 g/m$^2$ of silver, and the emulsion layer protective layer coating solution was then coated on the emulsion layer so as to give a dry thickness of 5 μm.

Some of the compounds used in the preparation of the sample are shown below.

(C-1)

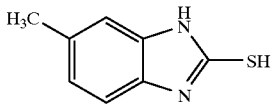

(C-2)

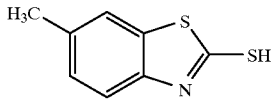

(C-3)

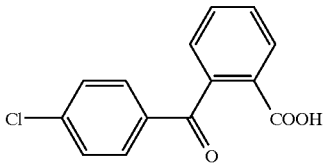

(C-4)

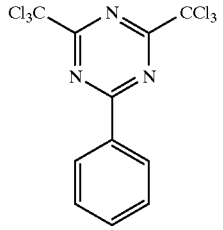

(C-5)

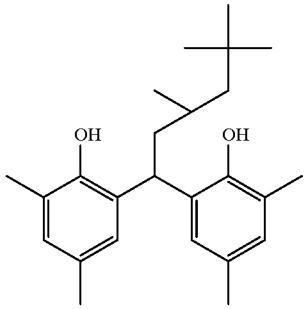

(C-6)

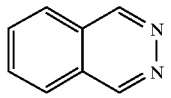

(C-7)

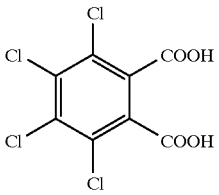

(C-8)

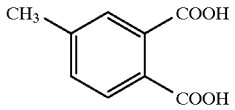

(C-9)

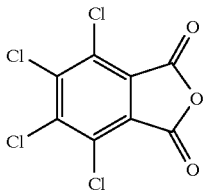

(C-10)

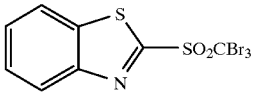

-continued
(C-11)
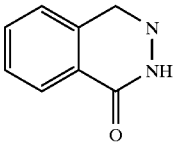
(C-12)
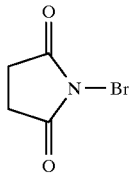
(C-13)
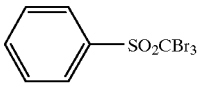
Disulfide compound A
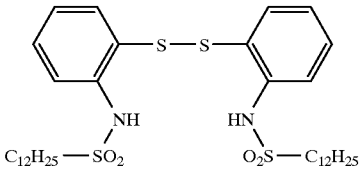
Sensitizing dye A
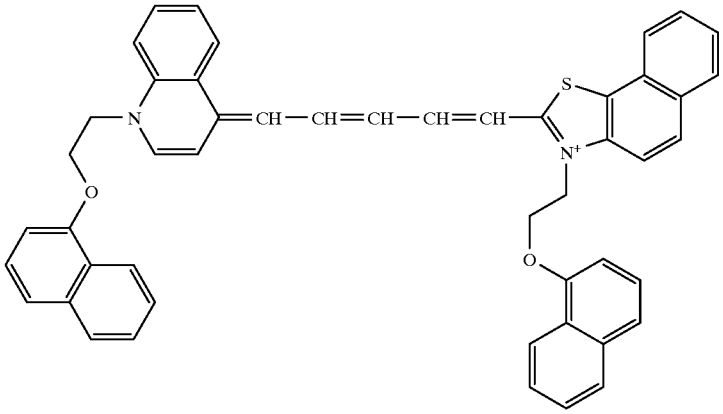
Sensitizing dye B
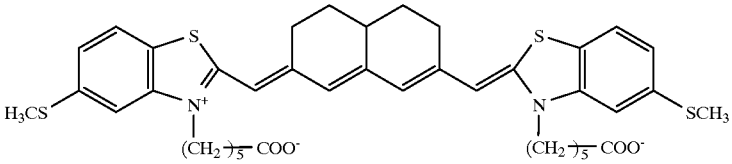
Dyestuff A
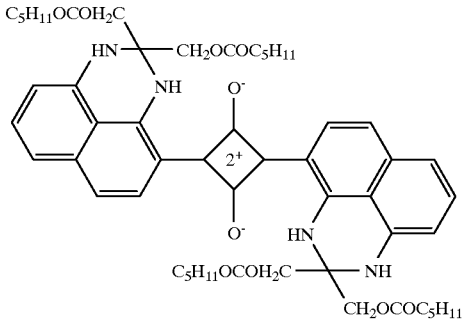
Dyestuff B
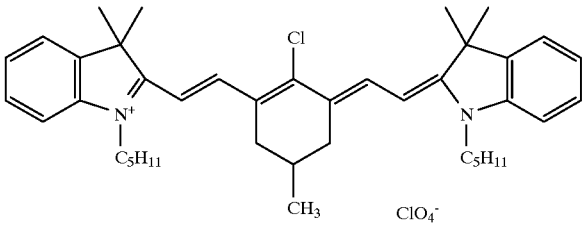

Photographic property test

The samples prepared above were exposed to xenon flash light for an emission time of $10^{-4}$ sec through an interference filter having a peak at 780 nm and a step wedge and heated for development at 115° C. for 25 seconds. The resulting images were determined for Dmax and sensitivity by a densitometer. The sensitivity (S) is the reciprocal of a ratio of the exposure providing a density of Dmin+1.5. The gradient of a straight line connecting points of density 0.3 and 3.0 on a characteristic curve is also reported as gradation (γ).

Storage test

To estimate how photographic properties change during long-term storage, the samples were aged for 5 days under conditions of 50° C. and RH 50%. A sensitivity change (ΔS) is equal to the sensitivity of aged sample minus the sensitivity of fresh sample. ΔS values approximate to 0 indicate better storage stability.

The results are shown in Table 9.

TABLE 9

| | Hydrazine | Addition amount (mol/mol Ag) | Dmax | S | γ | ΔS |
|---|---|---|---|---|---|---|
| 1* | — | — | 2.2 | 0.40 | — | 0.00 |
| 2* | Comparative Compound 1 | $9.0 \times 10^{-3}$ | 2.8 | 0.53 | — | 0.01 |
| 3* | Comparative Compound 2 | $5.0 \times 10^{-3}$ | 5.4 | 1.10 | 15.3 | 0.05 |
| 4 | 2a | $5.0 \times 10^{-3}$ | 5.5 | 1.15 | 15.8 | 0.00 |
| 5 | 2c | $6.0 \times 10^{-3}$ | 5.3 | 1.13 | 15.1 | 0.01 |
| 6 | 2d | $5.0 \times 10^{-3}$ | 5.4 | 1.14 | 15.7 | 0.00 |
| 7 | 2e | $6.0 \times 10^{-3}$ | 5.2 | 1.11 | 15.3 | 0.01 |
| 8 | 5a | $4.0 \times 10^{-3}$ | 5.3 | 1.14 | 15.6 | 0.00 |
| 9 | 5d | $4.0 \times 10^{-3}$ | 5.3 | 1.15 | 15.5 | 0.00 |
| 10 | 11a | $3.5 \times 10^{-3}$ | 5.5 | 1.15 | 16.2 | 0.00 |
| 11 | 11d | $3.5 \times 10^{-3}$ | 5.5 | 1.14 | 16.4 | 0.00 |
| 12 | 15a | $4.0 \times 10^{-3}$ | 5.4 | 1.16 | 16.0 | 0.00 |
| 13 | 15d | $4.0 \times 10^{-3}$ | 5.4 | 1.14 | 15.9 | 0.00 |
| 14 | 19a | $3.5 \times 10^{-3}$ | 5.5 | 1.13 | 15.8 | 0.00 |
| 15 | 19d | $3.5 \times 10^{-3}$ | 5.4 | 1.14 | 15.6 | 0.00 |
| 16 | 23a | $3.5 \times 10^{-3}$ | 5.4 | 1.15 | 15.5 | 0.00 |
| 17 | 23c | $4.0 \times 10^{-3}$ | 5.2 | 1.15 | 15.4 | 0.01 |
| 18 | 29a | $3.0 \times 10^{-3}$ | 5.5 | 1.16 | 15.8 | 0.00 |
| 19 | 32a | $3.0 \times 10^{-3}$ | 5.5 | 1.15 | 15.9 | 0.00 |
| 20 | 34a | $9.0 \times 10^{-3}$ | 5.1 | 1.08 | 14.8 | 0.01 |
| 21 | 48d | $1.2 \times 10^{-3}$ | 5.0 | 1.10 | 14.9 | 0.01 |
| 22 | 86 | $1.5 \times 10^{-3}$ | 5.1 | 1.12 | 15.0 | 0.01 |

*Comparative Compound

Comparative Compound 1

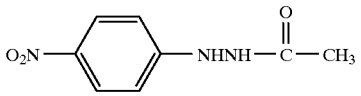

Comparative Compound 2

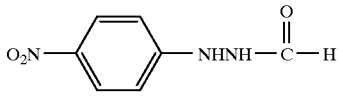

It is evident from Table 9 that using hydrazine derivatives within the scope of the invention, thermographic recording elements satisfying all the requirements of high Dmax, ultrahigh contrast, and storage stability are obtained.

Example 2

Preparation of silver halide grains B

In 900 ml of water were dissolved 7.5 grams of inert gelatin and 10 mg of potassium bromide. The solution was adjusted to pH 3.0 at a temperature of 35° C. To the solution, 370 ml of an aqueous solution containing 74 grams of silver nitrate and an aqueous solution containing potassium bromide and potassium iodide in a molar ratio of 94:6 and $K_3[IrCl_6]$ were added over 10 minutes by the controlled double jet method while maintaining the solution at pAg 7.7. Note that $[IrCl_6]^{3-}$ was added in an amount of $3\times10^{-7}$ mol/mol of silver. Thereafter, 0.3 gram of 4-hydroxy-6-methyl-1,3,3a,7-tetraazaindene was added to the solution, which was adjusted to pH 5 with NaOH. There were obtained cubic silver iodobromide grains B having a mean grain size of 0.06 μm, a coefficient of variation of projected area of 8%, and a {100} face ratio of 87%. The emulsion was desalted by adding a gelatin flocculant thereto to cause flocculation and sedimentation and then adjusted to pH 5.9 and pAg 7.5 by adding 0.1 gram of phenoxyethanol.

Preparation of organic acid silver emulsion B

A mixture of 10.6 grams of behenic acid and 300 ml of distilled water was mixed for 15 minutes at 90° C. With vigorous stirring, 31.1 ml of 1N sodium hydroxide was added over 15 minutes to the solution, which was allowed to stand at the temperature for one hour. The solution was then cooled to 30° C., 7 ml of 1N phosphoric acid was added thereto, and with more vigorous stirring, 0.13 gram of N-bromosuccinimide (C-12) was added. Thereafter, with stirring, the above-prepared silver halide grains B were added to the solution in such an amount as to give 2.5 mmol of silver halide. Further, 25 ml of 1N silver nitrate aqueous solution was continuously added over 2 minutes, with stirring continued for a further 90 minutes. With stirring, 37 grams of a 1.2 wt % butyl acetate solution of polyvinyl acetate was slowly added to the aqueous mixture to form flocs in the dispersion. Water was removed, and water washing and water removal were repeated twice. With stirring, 20 grams of a solution of 2.5% by weight polyvinyl butyral (Denka Butyral #3000-K) in a ½ solvent mixture of butyl acetate and isopropyl alcohol was added. To the thus obtained gel-like mixture of organic acid silver and silver halide, 7.8 grams of polyvinyl butyral (Denka Butyral #4000-2) and 57 grams of 2-butanone were added. The mixture was dispersed by a homogenizer, obtaining an organic acid silver salt emulsion B of needle grains having a mean minor diameter of 0.04 μm, a mean major diameter of 1 μm and a coefficient of variation of 30%.

Preparation of emulsion layer coating solution B

The following chemicals were added to the above-prepared organic acid silver salt emulsion B in amounts per mol of silver. With stirring at 25° C., 10 mg of sodium phenylthiosulfonate, 25 mg of Sensitizing Dye A, 20 mg of Sensitizing Dye B, 18 mg of Sensitizing Dye C, 2 grams of 2-mercapto-5-methylbenzimidazole (C-1), 21.5 grams of 4-chlorobenzophenone-2-carboxylic acid (C-3), 580 grams of 2-butanone and 220 grams of dimethylformamide were added to the emulsion, which was allowed to stand for 3 hours. With stirring, 4 grams of 4,6-ditrichloromethyl-2-phenyltriazine (C-4), 2 grams of Disulfide compound A, 170 grams of 1,1-bis(2-hydroxy-3,5-dimethylphenyl)-3,5,5-trimethylhexane (C-5), 15 grams of phthalazine (C-6), 5 grams of tetrachlorophthalic acid (C-7), an amount as shown in Table 10 of a hydrazine derivative within or outside the scope of the invention, 1.1 grams of Megafax F-176P, 590 grams of 2-butanone, and 10 grams of methyl isobutyl ketone were added to the emulsion.

Preparation of emulsion surface protective layer coating solution B

A coating solution B for an emulsion layer surface protective layer was prepared by dissolving 75 grams of CAB 171-15S, 5.7 grams of 4-methylphthalic acid (C-8), 1.5 grams of tetrachlorophthalic anhydride (C-9), 8 grams of tribromomethylsulfonylbenzene (C-13), 6 grams of 2-tribromomethylsulfonylbenzothiazole (C-10), 3 grams of phthalazone (C-11), 0.3 gram of Megafax F-176P, 2 grams of spherical silica Sildex H31 (mean size 3 μm), and 6 grams of polyisocyanate Sumidur N3500 in 3070 grams of 2-butanone and 30 grams of ethyl acetate.

Preparation of coated sample

A back layer coating solution was prepared by adding 6 grams of polyvinyl butyral Denka Butyral #4000-2, 0.2 gram of spherical silica Sildex H121 (mean size 12 μm), 0.2 gram of spherical silica Sildex H51 (mean size 5 μm), and 0.1 gram of Megafax F-176P to 64 grams of 2-propanol and mixing them into a solution. Further, a mixed solution of 420 mg of Dyestuff B in 10 grams of methanol and 20 grams of acetone and a solution of 0.8 gram of 3-isocyanatomethyl-3,5,5-trimethylhexyl isocyanate in 6 grams of ethyl acetate were added to the solution.

A polyethylene terephthalate film having a moisture-proof undercoat of vinylidene chloride on either surface was coated on one surface with the back surface coating solution so as to give an optical density of 0.7 at 780 nm.

On the thus prepared support, the emulsion layer coating solution was coated so as to give a coverage of 2 g/m$^2$ of silver and the emulsion layer protective layer coating solution was then coated on the emulsion layer so as to give a dry thickness of 5 μm.

Photographic property/storage tests

The samples were determined for photographic properties and storage stability as in Example 1. The results are shown in Table 10.

TABLE 10

| | Hydrazine | Addition amount (mol/mol Ag) | Dmax | S | γ | ΔS |
|---|---|---|---|---|---|---|
| 1* | — | — | 2.1 | 0.35 | — | 0.00 |
| 2* | Comparative Compound 3 | $8.0 \times 10^{-3}$ | 2.5 | 0.46 | — | 0.01 |
| 3* | Comparative Compound 4 | $4.5 \times 10^{-3}$ | 5.2 | 1.05 | 14.3 | 0.05 |
| 4 | 2a | $4.5 \times 10^{-3}$ | 5.3 | 1.09 | 14.6 | 0.00 |
| 5 | 2c | $5.0 \times 10^{-3}$ | 5.1 | 1.05 | 13.9 | 0.01 |
| 6 | 2d | $4.5 \times 10^{-3}$ | 5.2 | 1.10 | 14.6 | 0.00 |
| 7 | 2e | $5.0 \times 10^{-3}$ | 5.0 | 1.07 | 14.0 | 0.01 |
| 8 | 5a | $3.8 \times 10^{-3}$ | 5.0 | 1.10 | 14.7 | 0.00 |
| 9 | 5d | $3.8 \times 10^{-3}$ | 5.1 | 1.09 | 14.5 | 0.00 |
| 10 | 11a | $3.2 \times 10^{-3}$ | 5.4 | 1.11 | 14.8 | 0.00 |
| 11 | 11d | $3.2 \times 10^{-3}$ | 5.3 | 1.09 | 14.7 | 0.00 |
| 12 | 15a | $3.5 \times 10^{-3}$ | 5.1 | 1.10 | 14.9 | 0.00 |
| 13 | 15d | $3.5 \times 10^{-3}$ | 5.2 | 1.11 | 15.0 | 0.00 |
| 14 | 19a | $3.2 \times 10^{-3}$ | 5.1 | 1.07 | 14.3 | 0.00 |
| 15 | 19d | $3.2 \times 10^{-3}$ | 5.2 | 1.08 | 14.4 | 0.00 |
| 16 | 23a | $3.2 \times 10^{-3}$ | 5.3 | 1.10 | 14.5 | 0.00 |
| 17 | 23c | $3.5 \times 10^{-3}$ | 5.1 | 1.09 | 14.4 | 0.01 |
| 18 | 29a | $2.8 \times 10^{-3}$ | 5.4 | 1.12 | 14.7 | 0.00 |
| 19 | 32a | $2.8 \times 10^{-3}$ | 5.4 | 1.10 | 14.6 | 0.00 |
| 20 | 34a | $8.0 \times 10^{-3}$ | 5.0 | 1.06 | 14.1 | 0.01 |
| 21 | 48d | $1.0 \times 10^{-3}$ | 4.9 | 1.06 | 14.2 | 0.01 |
| 22 | 86 | $1.5 \times 10^{-3}$ | 4.8 | 1.04 | 14.0 | 0.01 |

*Comparative Compound

Comparative Compound 3

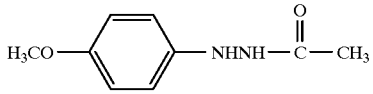

TABLE 10-continued

| Hydrazine | Addition amount (mol/mol Ag) | Dmax | S | γ | ΔS |
|---|---|---|---|---|---|

Comparative Compound 4

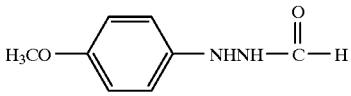

It is evident from Table 10 that using hydrazine derivatives within the scope of the invention, thermographic recording elements satisfying all the requirements of high Dmax, ultrahigh contrast, and storage stability are obtained.

Example 3

Silver halide emulsion C

In 700 ml of water were dissolved 22 grams of phthalated gelatin and 30 mg of potassium bromide. The solution was adjusted to pH 5.0 at a temperature of 40° C. To the solution, 159 ml of an aqueous solution containing 18.6 grams of silver nitrate and an aqueous solution containing potassium bromide were added over 10 minutes by the controlled double jet method while maintaining the solution at pAg 7.7. Then, an aqueous solution containing $8\times10^{-6}$ mol/liter of $K_3[IrCl_6]$ and 1 mol/liter of potassium bromide was added over 30 minutes by the controlled double jet method while maintaining the solution at pAg 7.7. The emulsion was adjusted to pH 5.9 and pAg 8.0. There were obtained cubic grains having a mean grain size of 0.07 μm, a coefficient of variation of the projected area diameter of 8%, and a (100) face proportion of 86%.

The thus obtained silver halide grains C were heated at 60° C., to which $8.5\times10^{-5}$ mol of sodium thiosulfate, $1\times10^{-5}$ mol of 2,3,4,5,6-pentafluorophenyldiphenylsulfin selenide, $2\times10^{-6}$ mol of Tellurium Compound 1, $3.3\times10^{-6}$ mol of chloroauric acid, and $2.3\times10^{-4}$ mol of thiocyanic acid were added per mol of silver. The emulsion was ripened for 120 minutes and then quenched to 50° C. With stirring, $8\times10^{-4}$ mol of Sensitizing Dye C was added, and $3.5\times10^{-2}$ mol of potassium iodide was added to the emulsion, which was stirred for 30 minutes and then quenched to 30° C., completing the preparation of a silver halide emulsion C.

Some of the compounds used in the preparation of the sample are shown below.

Sensitizing Dye C

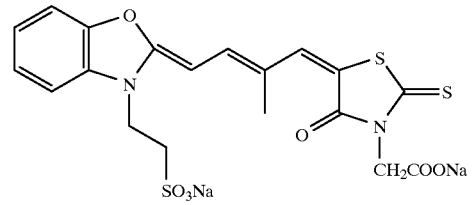

Tellurium Compound 1

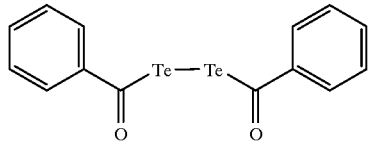

Organic acid silver microcrystalline dispersion

A mixture of 40 grams of behenic acid, 7.3 grams of stearic acid, and 500 ml of distilled water was stirred at 90° C. for 15 minutes. With vigorous stirring, 187 ml of 1N NaOH aqueous solution was added over 15 minutes, 61 ml of 1N nitric acid was added, and the solution was cooled to 50C. Then, 124 ml of an aqueous solution of 1N silver nitrate was added and stirring was continued for 30 minutes. Thereafter, the solids were separated by suction filtration and washed with water until the water filtrate reached a conductivity of 30 μS/cm. The thus obtained solids were handled as a wet cake without drying. To 34.8 grams as dry solids of the wet cake were added 12 grams of polyvinyl alcohol and 150 ml of water. They were thoroughly mixed to form a slurry. A vessel was charged with the slurry together with 840 grams of zirconia beads having a mean diameter of 0.5 mm. A dispersing machine (¼ G Sand Grinder Mill by Imex K.K.) was operated for 5 hours for dispersion, completing the preparation of a microcrystalline dispersion of organic acid silver grains having a volume weighed mean grain diameter of 1.5 μm as measured by Master Sizer X (Malvern Instruments Ltd.).

Solid particle dispersions of chemical addenda

Solid particle dispersions of tetrachlorophthalic acid (C-7), 4-methylphthalic acid (C-8), 1,1-bis(2-hydroxy-3,5-dimethylphenyl)-3,5,5-trimethylhexane (C-5), phthalazine (C-6), and tribromomethylsulfonylbenzene (C-13) were prepared.

To tetrachlorophthalic acid were added 0.81 gram of hydroxypropyl cellulose and 94.2 ml of water. They were thoroughly agitated to form a slurry, which was allowed to stand for 10 hours. A vessel was charged with the slurry together with 100 ml of zirconia beads having a mean diameter of 0.5 mm. A dispersing machine as above was operated for 5 hours for dispersion, obtaining a solid particle dispersion of tetrachlorophthalic acid in which particles with a diameter of up to 1.0 μm accounted for 70% by weight. Solid particle dispersions of the remaining chemical addenda were similarly prepared by properly changing the amount of dispersant and the dispersion time to achieve a desired mean particle size.

Emulsion layer coating solution

An emulsion layer coating solution was prepared by adding the following compositions to the organic acid silver microparticulate dispersion prepared above.

| | |
|---|---|
| Organic acid silver particle dispersion | 1 mol |
| Silver halide emulsion C | 0.05 mol |
| Binder: LACSTAR 3307B SBR latex | 430 g |
| Addenda for development: | |
| Tetrachlorophthalic acid | 5 g |
| 1,1-bis(2-hydroxy-3,5-dimethylphenyl)-3,5,5-trimethylhexane | 98 g |
| Phthalazine | 9.2 g |
| Tribromomethylphenylsulfone | 12 g |
| 4-methylphthalic acid | 7 g |
| Hydrazine derivative | (see Table 11) |

Note that the type and amount of hydrazine derivative added are shown in Table 11, the amount being expressed by mol per mol of silver.

Emulsion surface protective layer coating solution

A surface protective layer coating solution was prepared by adding 0.26 gram of Surfactant A, 0.09 gram of Surfactant B, 0.9 gram of silica microparticulates having a mean particle size of 2.5 μm, 0.3 gram of 1,2-bis (vinylsulfonylacetamide)ethane and 64 grams of water to 10 grams of inert gelatin.

Color developing agent dispersion A

To 35 grams of ethyl acetate were added 2.5 grams of Compound 1 and 7.5 grams of Compound 2. The mixture was agitated for dissolution. The solution was combined with 50 grams of a 10 wt % polyvinyl alcohol solution and agitated for 5 minutes by means of a homogenizer. Thereafter, the ethyl acetate was volatilized off for solvent removal purpose. Dilution with water yielded a color developing agent dispersion.

Surfactant A

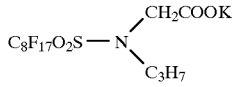

Surfactant B

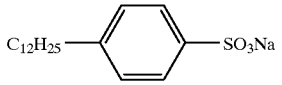

Compound 1

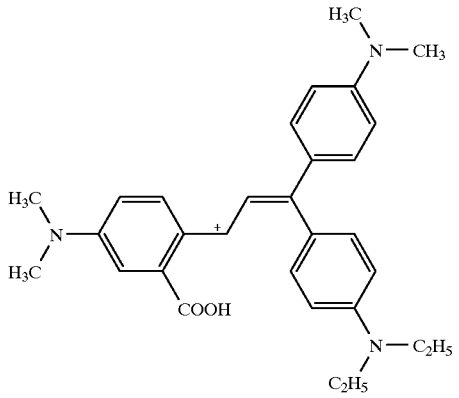

Compound 2

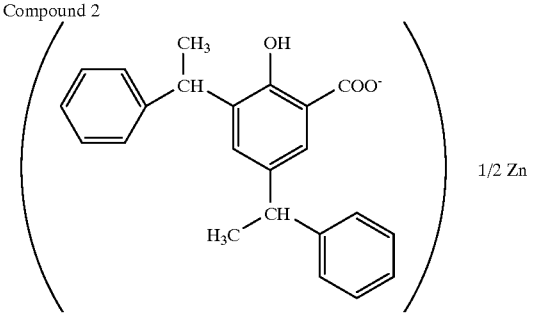

Back surface coating solution

A back surface coating solution was prepared by adding 50 grams of the color developing agent dispersion A, 20 grams of Additive A, 250 grams of water, and 1.8 grams of spherical silica Sildex H121 (mean size 12 μm) to 30 grams of polyvinyl alcohol.

Color developing agent dispersion A

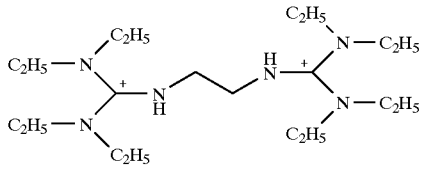

-continued

Additive A

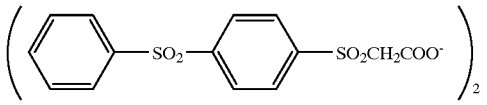

Coated sample

The emulsion layer coating solution was applied to a polyethylene terephthalate support so as to give a silver coverage of 1.6 g/m$^2$. The emulsion surface protective layer coating solution was coated thereto so as to give a gelatin coverage of 1.8 g/m$^2$. After drying, the back surface coating solution was applied to the back surface of the support opposite to the emulsion layer so as to give an optical density of 0.7 at 660 nm. A coated sample was prepared in this way.

Photographic property test

After the samples were exposed to xenon flash light for an emission time of $10^{-4}$ sec through an interference filter having a peak at 656 nm and a step wedge, they were tested as in Example 1.

Storage test

The samples were tested as in Example 1.

The results are shown in Table 11.

TABLE 11

| | Hydrazine | Addition amount (mol/mol Ag) | Dmax | S | γ | ΔS |
|---|---|---|---|---|---|---|
| 1* | — | — | 2.0 | 0.35 | — | 0.00 |
| 2* | Comparative Compound 5 | 9.5 × 10−3 | 2.5 | 0.42 | — | 0.01 |
| 3* | Comparative Compound 6 | 5.0 × 10−3 | 4.8 | 1.12 | 15.0 | 0.06 |
| 4 | 2a | $5.0 \times 10^{-3}$ | 4.9 | 1.13 | 15.5 | 0.00 |
| 5 | 2c | $6.0 \times 10^{-3}$ | 4.8 | 1.10 | 14.8 | 0.01 |
| 6 | 2d | $5.0 \times 10^{-3}$ | 4.9 | 1.13 | 15.4 | 0.00 |
| 7 | 2e | $6.0 \times 10^{-3}$ | 4.6 | 1.11 | 15.0 | 0.01 |
| 8 | 5a | $4.0 \times 10^{-3}$ | 4.7 | 1.14 | 15.3 | 0.00 |
| 9 | 5d | $4.0 \times 10^{-3}$ | 4.7 | 1.13 | 15.2 | 0.00 |
| 10 | 11a | $3.5 \times 10^{-3}$ | 4.5 | 1.14 | 15.9 | 0.00 |
| 11 | 11d | $3.5 \times 10^{-3}$ | 4.5 | 1.15 | 16.1 | 0.00 |
| 12 | 15a | $4.0 \times 10^{-3}$ | 4.6 | 1.13 | 15.7 | 0.00 |
| 13 | 15d | $4.0 \times 10^{-3}$ | 4.7 | 1.14 | 15.6 | 0.00 |
| 14 | 19a | $3.5 \times 10^{-3}$ | 4.5 | 1.15 | 15.5 | 0.00 |
| 15 | 19d | $3.5 \times 10^{-3}$ | 4.7 | 1.14 | 15.3 | 0.00 |
| 16 | 23a | $3.5 \times 10^{-3}$ | 4.6 | 1.13 | 15.2 | 0.00 |
| 17 | 23c | $4.0 \times 10^{-3}$ | 4.8 | 1.14 | 15.1 | 0.01 |
| 18 | 29a | $3.0 \times 10^{-3}$ | 4.8 | 1.15 | 15.5 | 0.00 |
| 19 | 32a | $3.0 \times 10^{-3}$ | 4.9 | 1.15 | 15.6 | 0.00 |
| 20 | 34a | $9.0 \times 10^{-3}$ | 4.7 | 1.14 | 14.5 | 0.01 |
| 21 | 48d | $1.2 \times 10^{-3}$ | 4.5 | 1.13 | 14.6 | 0.01 |
| 22 | 86 | $1.5 \times 10^{-3}$ | 4.3 | 1.11 | 14.7 | 0.01 |

*Comparative Compound

Comparative Compound 5

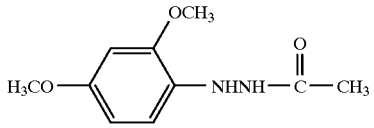

Comparative Compound 6

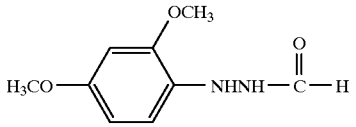

It is evident from Table 11 that using hydrazine derivatives within the scope of the invention, thermographic recording elements satisfying all the requirements of high Dmax, ultrahigh contrast, and storage stability are obtained.

There has been described a thermographic recording element having improved storage stability and forming images of high Dmax.

Japanese Patent Application No. 166628/1997 is incorporated herein by reference.

Reasonable modifications and variations are possible from the foregoing disclosure without departing from either the spirit or scope of the present invention as defined by the claims.

We claim:

1. A thermographic recording element comprising at least an organic acid silver salt, a reducing agent, and a hydrazine derivative of the following formula (I):

(I)

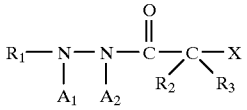

wherein $R_1$ is an aromatic, aliphatic or heterocyclic group, $A_1$ and $A_2$ are both hydrogen, or one of $A_1$ and $A_2$ is hydrogen and the other is a substituted or unsubstituted alkylsulfonyl, substituted or unsubstituted arylsulfonyl, or substituted or unsubstituted acyl group, $R_2$ and $R_3$ are independently hydrogen or substituents, and X is —OH, —SH, —NHCOR, —NHSO$_2$R, —NHCONRnRn', —NHSO$_2$NRnRn', —NHCO$_2$R, —NHCOCONRnRn', —NHCOCO$_2$R, —NHCONRnSO$_2$R or —NRnRn' wherein R is a substituted or unsubstituted alkyl, aryl or heterocyclic group, Rn and Rn' are independently hydrogen, substituted or unsubstituted alkyl, aryl or heterocyclic groups.

2. The thermographic recording element of claim 1 further comprising a photosensitive silver halide, the element being photosensitive.

3. The thermographic recording element of claim 1 wherein in formula (I), $R_1$ is a substituted or unsubstituted phenyl group, substituted alkyl group of 1 to 3 carbon atoms or substituted or unsubstituted heterocyclic group of up to 10 carbon atoms.

4. The thermographic recording element of claim 1 wherein in formula (I), both $A_1$ and $A_2$ are hydrogen.

5. The thermographic recording element of claim 1 wherein in formula (I), $R_1$ is a substituted phenyl group.

6. The thermographic recording element of claim 1 wherein in formula (I), both $R_2$ and $R_3$ are hydrogen.

7. The thermographic recording element of claim 1 wherein in formula (I), X is —OH, —SH, —NHCOR, —NHSO$_2$R or —NRnRn'; wherein, R, Rn and Rn' are as defined in claim 1.

8. The thermographic recording element of claim 1 wherein the organic acid silver is a silver salt of a long chain aliphatic carboxylic acid having 10 to 30 carbon atoms.

9. The thermographic recording element of claim 1 having an image forming layer comprising a binder which contains at least 50% by weight based on the entire binder of a polymer latex having a minimum film-forming temperature of about −30° C. to 90° C., said image forming layer being formed by coating a coating solution in a solvent containing at least 30% by weight of water.

10. The thermographic recording element of claim 1 having an image forming layer comprising a binder which is selected from the group consisting of polyvinyl butyral, butyl ethyl cellulose, methacrylate copolymers, maleic anhydride ester copolymers, polystyrene, and butadiene-styrene copolymers.

11. The thermographic recording element of claim 1 wherein the reducing agent is a bisphenol.

* * * * *